US008382100B2

(12) United States Patent
Izawa et al.

(10) Patent No.: US 8,382,100 B2
(45) Date of Patent: Feb. 26, 2013

(54) DEVICE FOR CONCENTRICALLY TRANSPORTING DOCUMENTS THROUGH PASSAGEWAY

(75) Inventors: Shinya Izawa, Tokyo (JP); Koji Nishimura, Tokyo (JP); Atsunori Hara, Tokyo (JP); Taichi Sato, Tokyo (JP); Nobuyuki Tane, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 12/922,190

(22) PCT Filed: Mar. 10, 2009

(86) PCT No.: PCT/JP2009/001072

§ 371 (c)(1), (2), (4) Date: Dec. 7, 2010

(87) PCT Pub. No.: WO2009/113299

PCT Pub. Date: Sep. 17, 2009

(65) Prior Publication Data

US 2011/0095474 A1 Apr. 28, 2011

(30) Foreign Application Priority Data

Mar. 14, 2008 (JP) ..... 2008-066776

(51) Int. Cl.
*B65H 9/00* (2006.01)

(52) U.S. Cl. ..... 271/240; 271/248; 194/206

(58) Field of Classification Search ..... 271/240, 271/248, 226, 234, 238, 239, 249, 250; 194/206
See application file for complete search history.

(56) References Cited

U.S. PATENT DOCUMENTS

| | | | | | |
|---|---|---|---|---|---|
| 2,528,106 | A * | 10/1950 | Albrecht | 271/240 |
| 4,381,108 | A * | 4/1983 | Newsome | 271/198 |
| 4,767,116 | A * | 8/1988 | Eberle | 271/238 |
| 5,269,119 | A * | 12/1993 | Tolson | 53/374.5 |
| 6,454,257 | B1 * | 9/2002 | Cisar | 271/254 |
| 6,461,101 | B1 * | 10/2002 | Roskam | 414/790.8 |

(Continued)

FOREIGN PATENT DOCUMENTS

| | | |
|---|---|---|
| EP | 1304305 A2 | 4/2003 |
| JP | 55-115891 | 9/1980 |

(Continued)

OTHER PUBLICATIONS

European Search Report for EP Patent Application No. 09720171.9.

(Continued)

*Primary Examiner* — Jeremy R Severson
(74) *Attorney, Agent, or Firm* — Bachman & LaPointe, P.C.

(57) ABSTRACT

A device is provided for continuously and concentrically transporting documents of different width through a passageway at a high speed. The device comprises a pair of opposed rollers 131 rotatably mounted on the opposite sides of a passageway 11 to grasp the opposite sides of a bill 70 between rotators 131, 132. At the moment of grasp between rollers 131, a central line C of bill 70 is automatically brought into alignment with a central line G of front passageway 11, and at the same time, bill 70 is grasped by opposed rollers 131 rotating in the adverse directions each other so that rotational force of rollers 131 applied to bill 70 serves to flip bill 70 to the rear of passageway 11.

9 Claims, 21 Drawing Sheets

U.S. PATENT DOCUMENTS

| | | | | |
|---|---|---|---|---|
| 6,801,302 | B2 * | 10/2004 | Mancuso et al. | 355/72 |
| 7,240,780 | B2 | 7/2007 | Nago et al. | |
| 7,810,807 | B2 * | 10/2010 | Liebheit | 271/238 |
| 2002/0140802 | A1 * | 10/2002 | Yamada | 347/262 |

FOREIGN PATENT DOCUMENTS

| | | | | |
|---|---|---|---|---|
| JP | 59017442 | A | | 1/1984 |
| JP | 59-88047 | | | 6/1984 |
| JP | 59088047 | U | * | 6/1984 |
| JP | 59-177688 | | | 10/1984 |
| JP | 63-165254 | | | 7/1988 |
| JP | 03-186538 | | | 8/1991 |
| JP | 08-012137 | | | 1/1996 |
| JP | 10-218482 | | | 8/1998 |
| JP | 11-314802 | | | 11/1999 |
| JP | 2000-351479 | | | 12/2000 |
| JP | 2005-089083 | | | 4/2005 |
| JP | 2005-115811 | | | 4/2005 |

OTHER PUBLICATIONS

Official action dated May 22, 2012 for JP 2008-66776.

* cited by examiner

DEVICE FOR CONCENTRICALLY TRANSPORTING DOCUMENTS THROUGH PASSAGEWAY

TECHNICAL FIELD

This invention relates to a device for continuously and concentrically transporting at a high speed documents of different width through a passageway in a document validator.

BACKGROUND OF THE INVENTION

When a valuable document such as a bill, valuable security or coupon is inserted into a passageway of a document validator, a conveyor device automatically transports the document along the passageway after the document is aligned (centered) with the passageway so as to bring a longitudinal central line of the document in register with a longitudinal central line of the passageway. A validation sensor is provided at a predetermined location in the passageway to detect physical features such as optical or magnetic features of prescribed areas in the transported document. To align the inserted documents of different width with the passageway leads to exact detection of physical features in correct areas of the document by validation sensor.

For example, a document validator disclosed in Patent Document 1 mentioned below has a centering device that comprises guide rollers in contact to a conveyor belt for transporting an inserted bill along a passageway and movable between the contact position and spaced position away from conveyor belt, and a pair of pinch jaws of channel-shaped section moved toward each other to grip opposite sides of bill in passageway so that pinch jaws make a longitudinal central axis of bill come coaxial with longitudinal central axis of passageway. When centered, bill produces extremely increased resistance against the buckling by pinch jaws due to stiffness of bill, and therefore, a rotor of a centering motor arrives at a power-swing damping or slippage to forcibly hinder further rotation of centering motor when increased resistance over a predetermined level is applied to centering motor. At the moment, operation of centering motor is ceased to stop movement of pinch jaws. Then, centering motor is driven in the adverse direction to return pinch jaws away from bill to the original outermost position, and guide rollers are returned from the separated position to the contact position to bring guide rollers into contact to bill which are therefore further inwardly moved along passageway to detect authenticity of bill by a validation sensor.

[Patent Document 1] Japanese Patent Disclosure No. 2005-115811

Problem to be Solved by the Invention

Document validator of Patent Document 1 is operated in accordance with the sequence comprising the steps of: firstly after stopping once forward movement of the inserted bill along passageway, guide rollers are removed away from bill and a pair of pinch jaws are moved closer to each other for centering of bill; after bringing central axis of bill into alignment with central axis of passageway, pinch rollers are separated from each other; guide rollers again come into contact to bill to transport it further inwardly of passageway; and validation sensor is used to validate bill within passageway. Thus, the prior art document validator disadvantageously represents a longer processing time and delay in validating authenticity of bills because from insertion to validation of bill, it needs several motions inclusive of transportation and its stoppage of bill, removal of guide rollers from bill, access of pinch jaws each other, centering operation by pinch jaws, separation of pinch jaws, and repetitive contact of guide rollers to bill.

Accordingly, an object of the present invention is to provide a device for continuously centering and transporting documents of different width through a passageway at a high rate.

SUMMARY OF THE INVENTION

The device for concentrically transporting documents according to the present invention comprises: a pair of opposed rotators (131, 132) rotatably mounted on the opposite sides of a passageway (11) to move rotators (131, 132) in the transverse direction to a longitudinal direction of passageway (11), a centering motor (30) for moving rotators (131, 132) in the transverse direction towards each other when a document (70) is disposed on passageway (11) between rotators (131, 132) to grasp the opposite sides of document (70) between rotators (131, 132) and then moving rotators (131, 132) away from each other, and a drive motor (20) for rotating rotators (131, 132) in the counter directions at the same rate of rotation when centering motor (30) moves rotators (131, 132) towards each other to convey inwardly of passageway (11) document (70) grasped between rotating rotators (131, 132).

When moved document (70) is grasped between rotating rotators (131, 132), at the moment of the grasp, a central line (C) of document (70) is automatically brought into alignment with a central line (G) of passageway (11). At the same time, document (70) is grasped by opposed rotators (131, 132) rotating in the adverse directions each other while document (70) is deformed into an arcuate shape against its own elasticity, and so, rotational force of rotators (131, 132) applied to document (70) serves to flip or flick document (70) at an accelerated rate further inwardly of passageway (11) in the tangential direction of outer periphery in rotators (131, 132) in contact to opposite sides of document (70). In this way, the device can, continuously and at a high speed, transport, grasp, center and flip document (70) further inwardly of passageway (11) by rotating opposed rotators (131, 132) to accelerate speed in transportation for processing document (70) in a document validator incorporated with the device.

Effect of Invention

The device can validate a plurality of documents at a high rate of speed and with high accuracy through rapid alignment and transportation of document.

Figure 1:
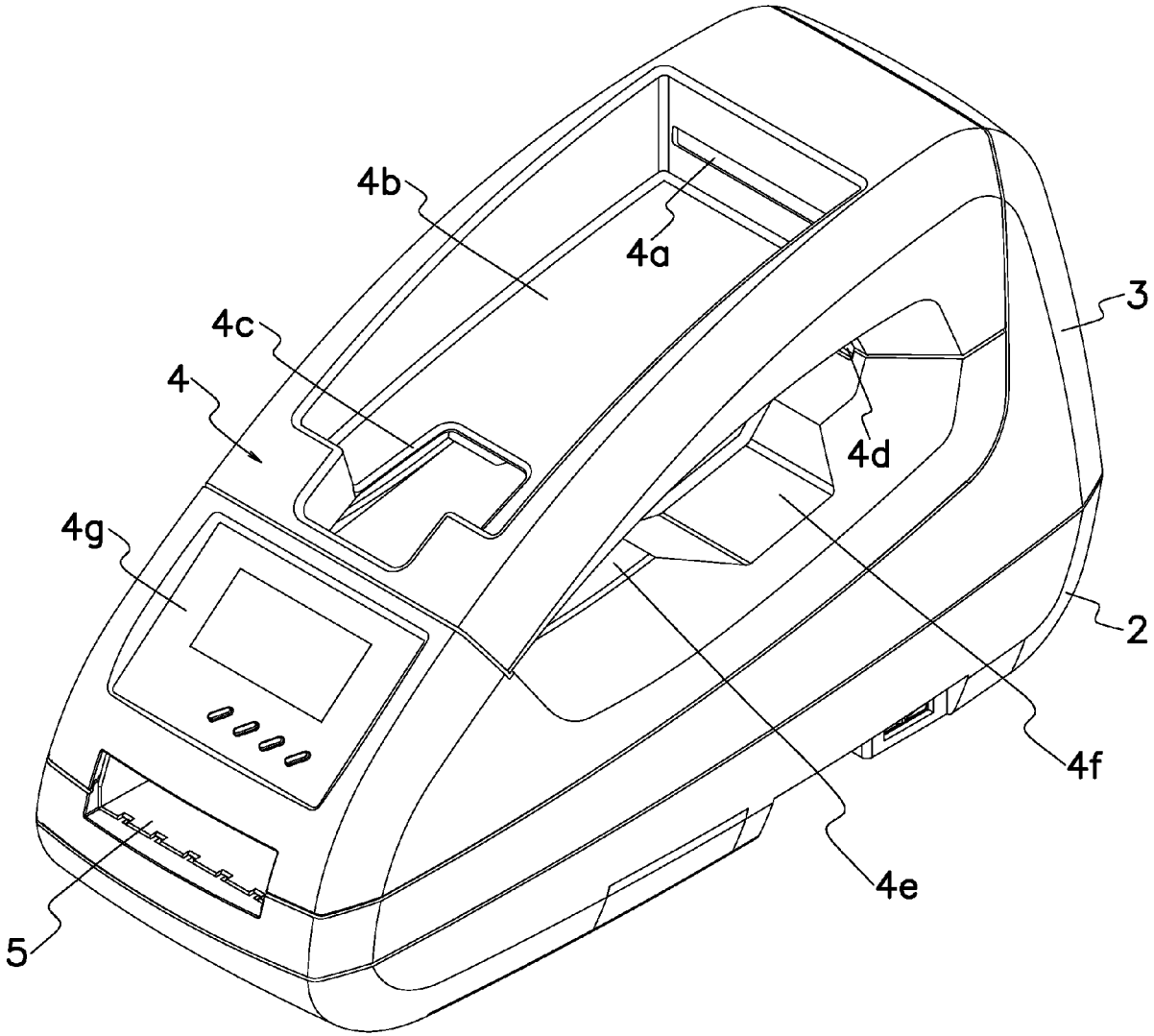
FIG. 1 A perspective view of a bill validator incorporated with the device of this invention.

EXPLANATION OF SYMBOLS (1) . . . a conveyor, (2) . . . a bottom cabinet, (3) . . . a cover, (4) . . . an upper cabinet, (4*a*) . . . an upper outlet, (4*b*) . . . an upper tray, (4*c*) . . . a notch, (4*d*) . . . a lower outlet, (4*e*) . . . a lower tray, (4*f*) . . . dents, (5) . . . a bill inlet, (5*a*) . . . an inlet tray, (6) . . . an open button, (7) . . . an introduction device, (7*a*) . . . an upper unit, (7*b*) . . . a lower unit, (8) . . . a transport device, (8*a*) . . . a rotary bracket, (9) . . . a rear passageway, (9*a*) . . . a deflector, (10) . . . a discharge device, (11) . . . a front passageway, (12) . . . bearing blocks, (12*c*, 12*d*) . . . pedestals, (131) . . . opposed rollers (opposed rotators), (132) . . . opposed belts (opposed rotators), (13*c*) . . . a first final gear, (13*d*) . . . a second final gear, (13*e*) . . . a first auxiliary roller, (13*f*) . . . a second auxiliary roller, (14) . . . a transmission device, (15) . . . a centering device, (16*a* to 16*c*) . . . drive belts, (17) . . . a drive roller, (18*a* to 18*h*) . . . intervenient rollers, (19) . . . a drive gearing, (20) . . . a drive motor, (21) . . . an intake motor, (21*a*) . . . a pinion, (22) . . . a shutter, (23) . . . a gear train, (23*a* to 23*l*) . . . first to twelfth gears, (24) . . . a feed roller, (25) . . . an intake roller, (26) . . . a retard roller, (27) . . . a bracket, (27*a*) . . . a main drive gear, (27*b*) . . . an intermediate gear, (27*c*) . . . a follower gear, (28) . . . an actuator, (29) . . . a linkage, (30) . . . a centering motor, (31) . . . a pinion, (32) . . . an intermediate large gear, (33) . . . an intermediate small gear, (34) . . . a shaft gear, (35) . . . a feed shaft, (36) . . . a release shaft, (36*a*) . . . a centering gear, (37) . . . a large gear, (38) . . . a small gear, (39, 40) . . . bevel gears, (41) . . . a drive gear, (42) . . . a first epicyclic gear train (a power divider), (43) . . . a second epicyclic gear train (a power divider), (44) . . . a first control gear train, (45) . . . a second control gear train, (46) . . . a first sun gear, (47) . . . a second sun gear, (48) . . . a first epicyclic gear, (49) . . . a second epicyclic gear, (50) . . . a first link, (51) . . . a second link, (52) . . . a first final link, (53) . . . a second final link, (60) . . . a control device, (61) . . . an intake sensor, (62) . . . a centering finish sensor, (63) . . . an intake finish sensor, (64) . . . a validation sensor, (65) . . . a validation finish sensor, (66) . . . an upper outlet sensor, (67) . . . a lower outlet sensor, (70) . . . a bill, (81) . . . a conveyor roller, (82) . . . a conveyor belt, (83) . . . a pinch roller,

BEST MODE FOR CARRYING OUT THE INVENTION

Embodiments of the bill validator incorporated with the device according to the present invention will be described hereinafter in connection with FIGS. 1 to 27 of the drawings. In the description herein, a "bill" denotes a "document" which however may include a bill, a coupon, a valuable security, a ticket, a card or any other valuable document or paper to be prevented forgery.

Figure 2:
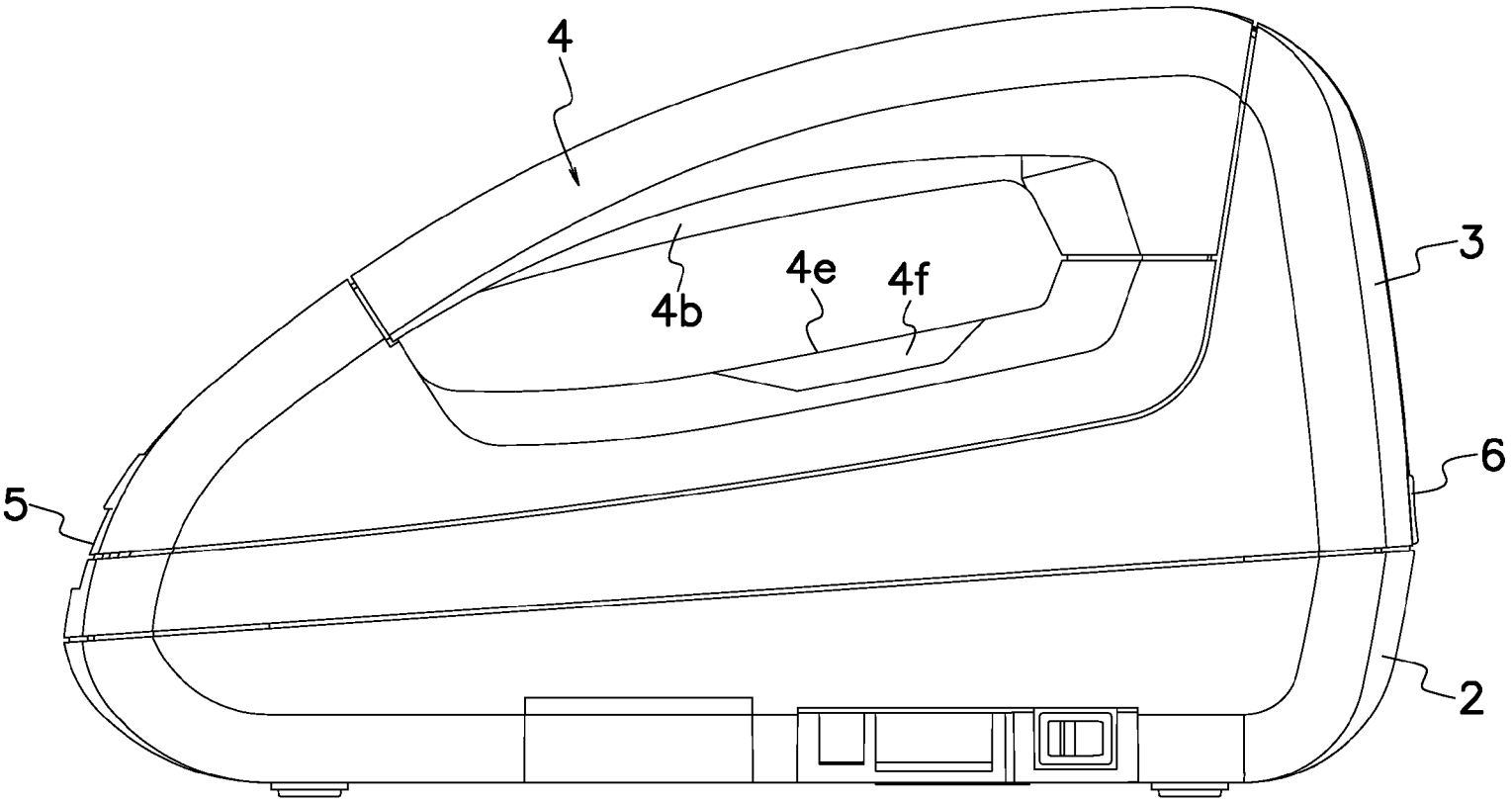
FIG. 2 A side elevation view of the bill validator shown in FIG. 1.
Figure 3:
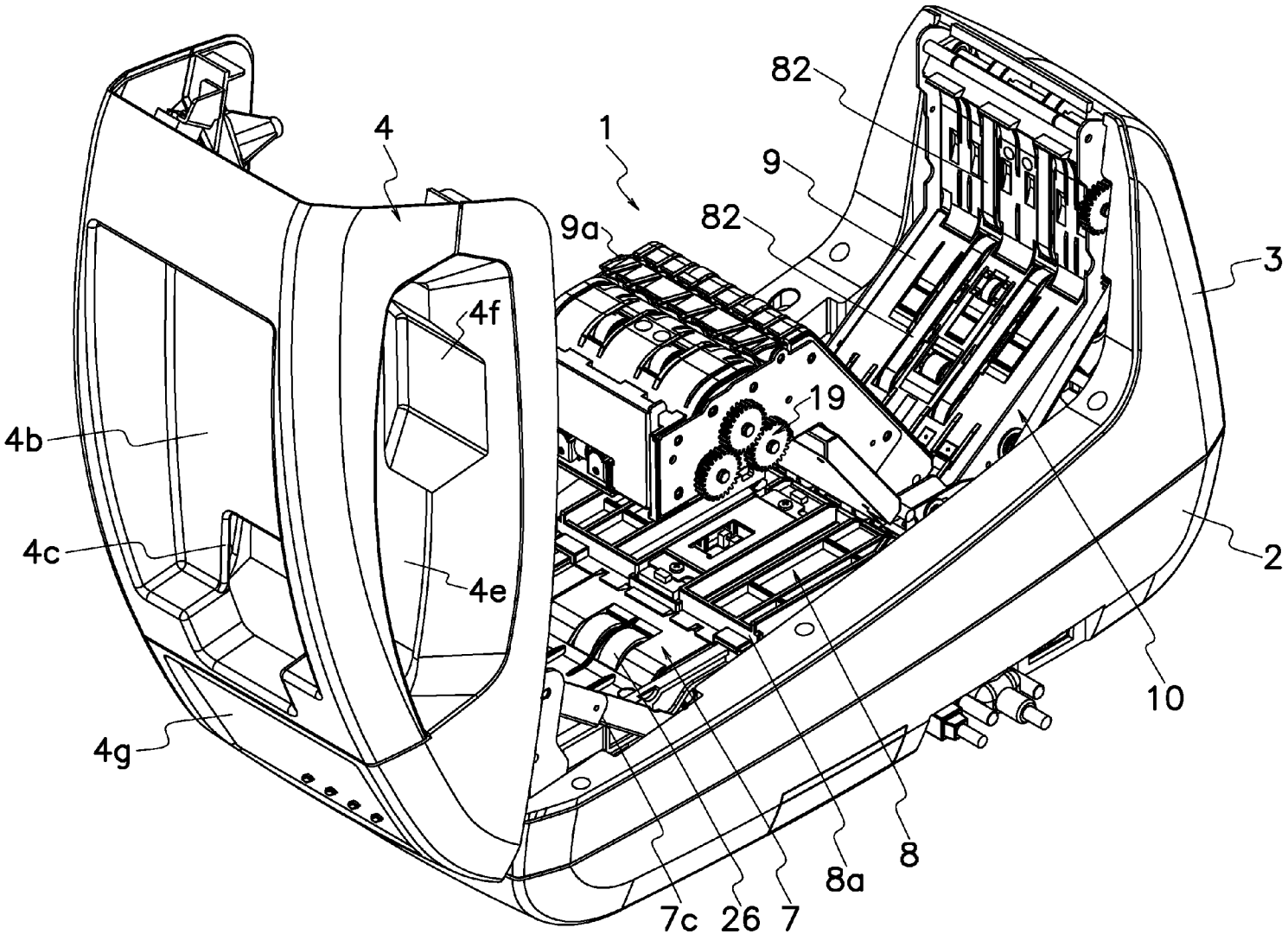
FIG. 3 A perspective view of the bill validator shown in FIG. 1 with an opened upper cabinet and an opened upper unit to show a discharge device.
Figure 5:
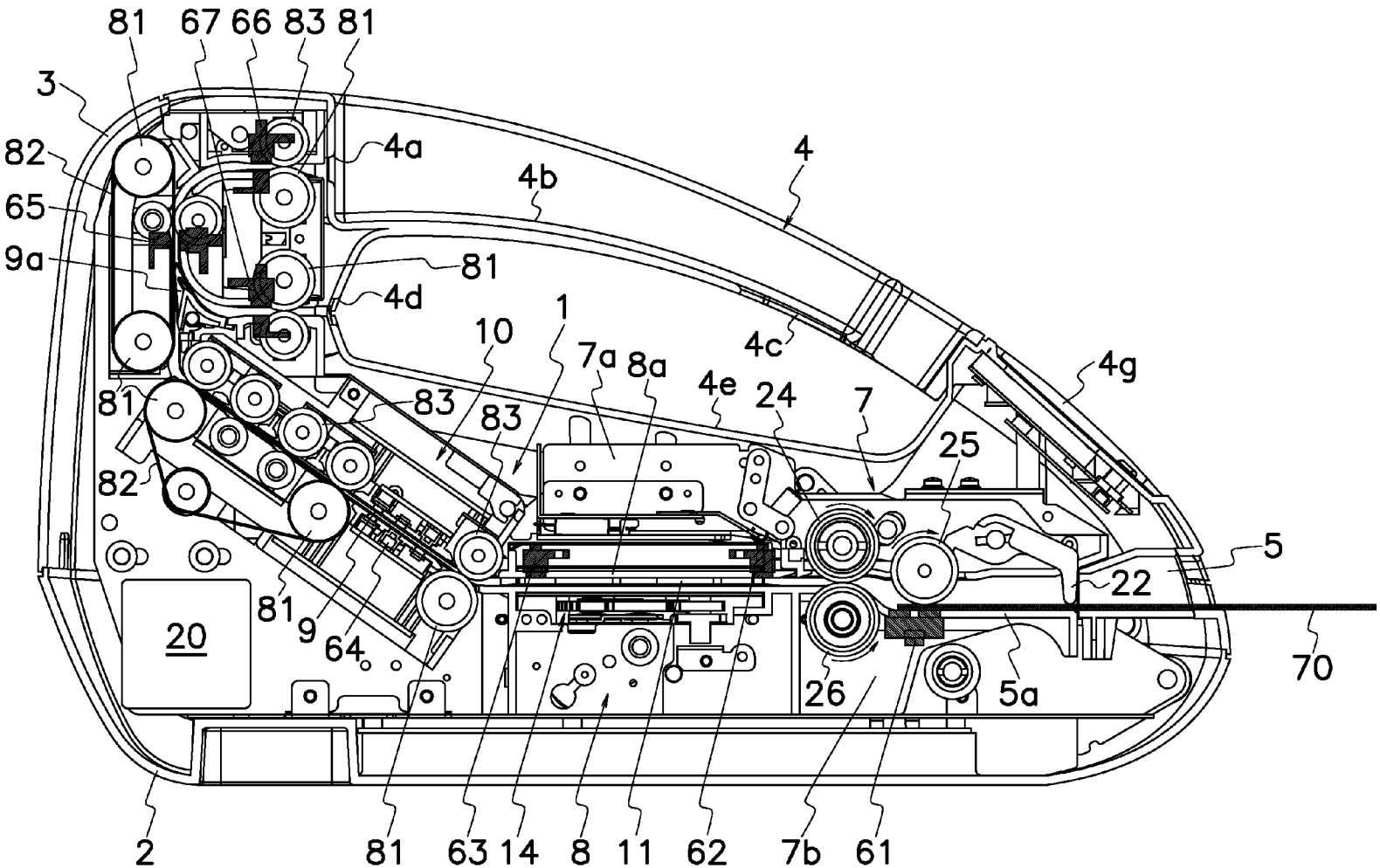
FIG. 5 A sectional view of the bill validator indicating intake rollers in the operative position in contact to a bill.

As shown in FIGS. 1 and 2, the bill validator in this embodiment comprises a bottom cabinet 2 attached to a bottom of a conveyor 1 shown in FIG. 3, a cover 3 attached at an upper portion of bottom cabinet 2 for covering a back side of conveyor 1, and an upper cabinet 4 attached to conveyor 1 to rotate upper cabinet 4 over conveyor 1 so as to open and close relative to bottom cabinet 2 and cover 3. A bill inlet 5 is formed on and over front walls of upper cabinet 4 and cover 3, and a release button 6 (FIG. 2) is provided at a rear wall of cover 3. Not shown in detail, but release button 6 is pressed to unclasp a latch not shown to open upper cabinet 4 from cover 3. Upper cabinet 4 comprises an upper outlet 4*a* for discharging a bill decided as genuine, an upper tray 4*b* connected to upper outlet 4*a* for receiving a bill discharged from upper outlet 4*a*, an opening 4*c* formed in a part of upper tray 4*b*, a lower outlet 4*d* for discharging a bill decided as false, a lower tray 4*e* connected to lower outlet 4*d* for receiving a bill discharged from lower outlet 4*d*, a pair of dents 4*f* formed on opposite sides of lower tray 4*e*, and a display control panel 4*g* provided on upper cabinet 4 over bill inlet 5 and having an LCD (liquid crystal display) and manual operation buttons. As shown in FIG. 5, an introduction device 7 comprises an upper unit 7*a* attached under upper cabinet 4 to open and close upper unit 7*a* by a link device 7*c* shown in FIG. 10 relative to a lower unit 7*b* secured to bottom cabinet 2.

As seen in FIGS. 3 and 5, conveyor 1 comprises introduction device 7, a transport device 8 and a discharge device 10. Introduction device 7 comprises an intake roller 25 movable between the lower operative position shown in FIG. 6 and the upper inoperative position. When introduction device 7 is in the operative position shown in FIG. 6, intake roller 25 is maintained urged on an intake sensor 61 disposed beneath intake roller 25 to grasp bill 70 inserted into bill inlet 5 between intake roller 25 and intake sensor 61 and to thereby introduce bill 70 into inside of introduction device 7. When introduction device 7 is in the inoperative position shown in FIG. 9, intake roller 25 is maintained upwardly away from intake sensor 61 to stop conveyance of bill 70. Transport device 8 serves to align a central line of bill 70 fed by introduction device 7 with a central line of a front passageway 11 and further transport bill 70. Discharge device 10 conveys further inside of conveyor 1 bill 70 fed from transport device 8 along a rear passageway 9. Conveyor 1 comprises a control device 60 (FIG. 22) for controlling operations of introduction device 7, transport device 8 and discharge device 10.

Figure 4:
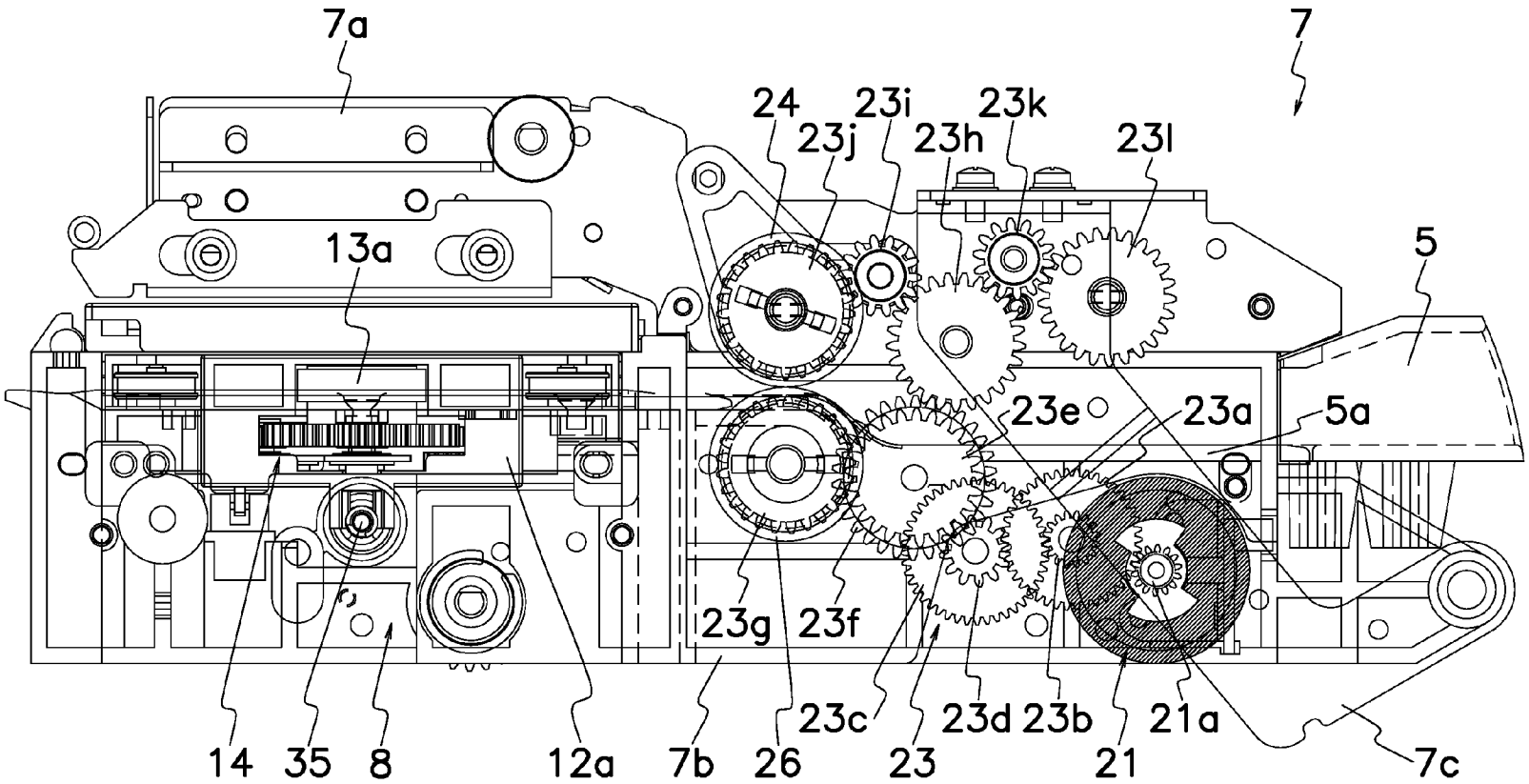
FIG. 4 A sectional view of an introduction device in the bill validator.
Figure 6:
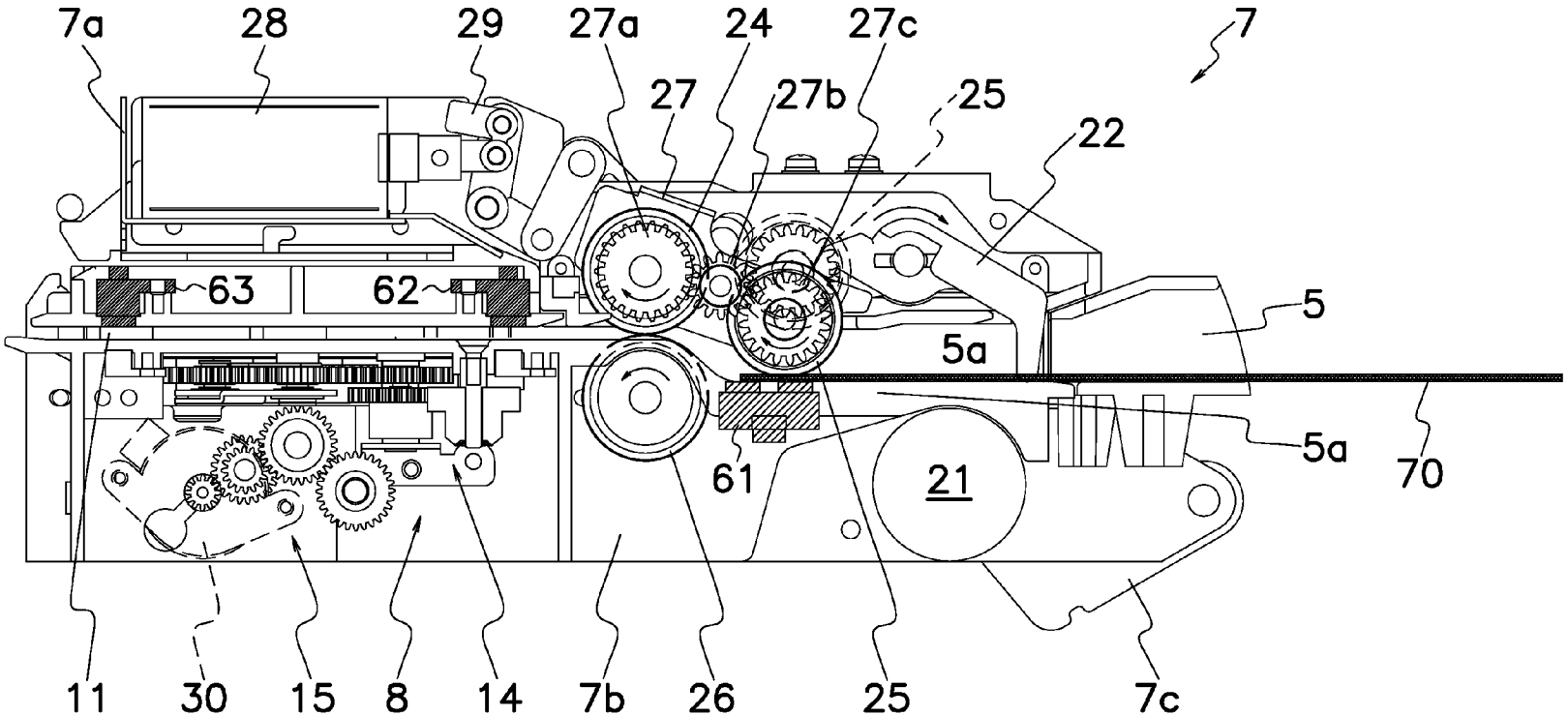
FIG. 6 A sectional view of the introduction device indicating a bracket in the operative position.
Figure 7:
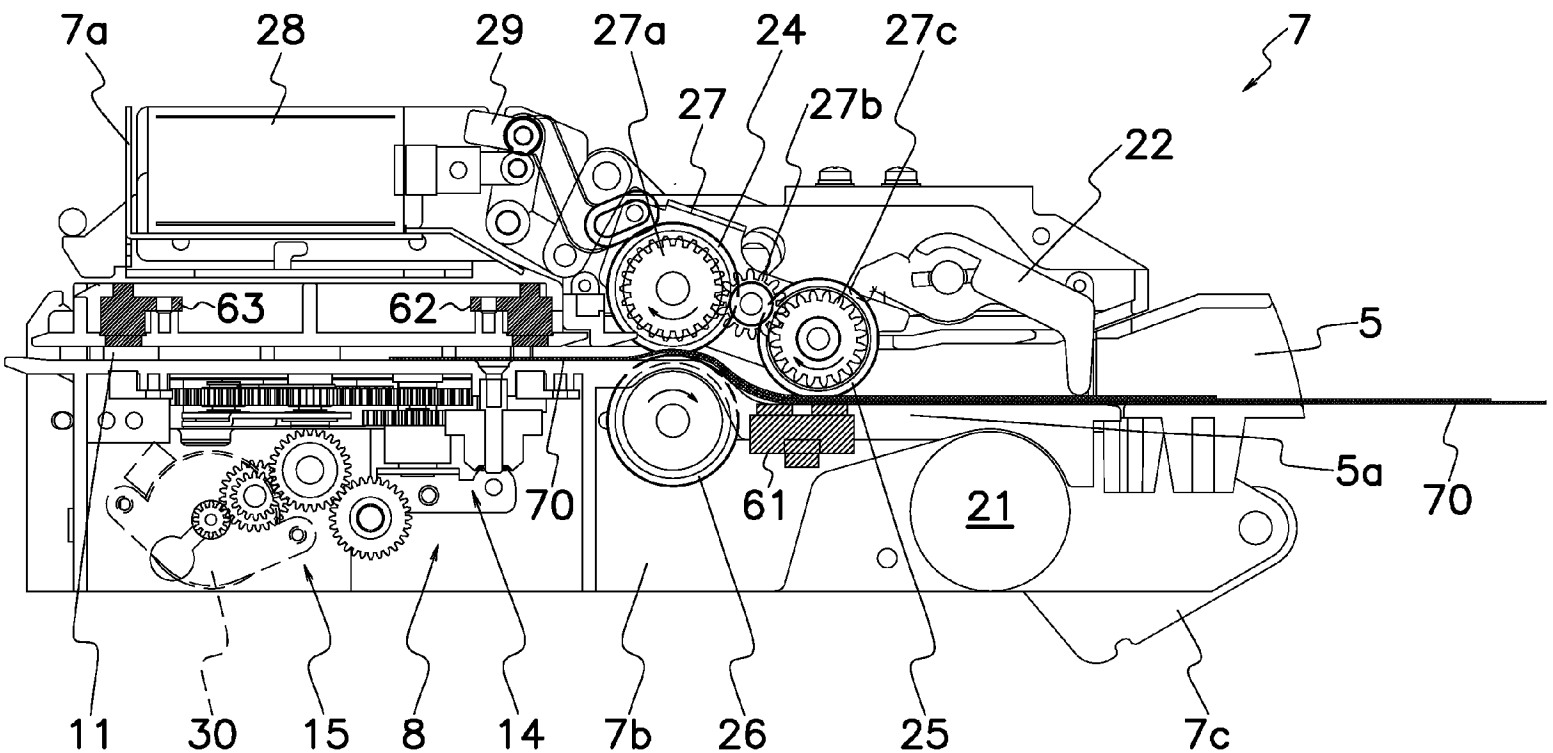
FIG. 7 A sectional view of the introduction device indicating a retard roller.
Figure 9:
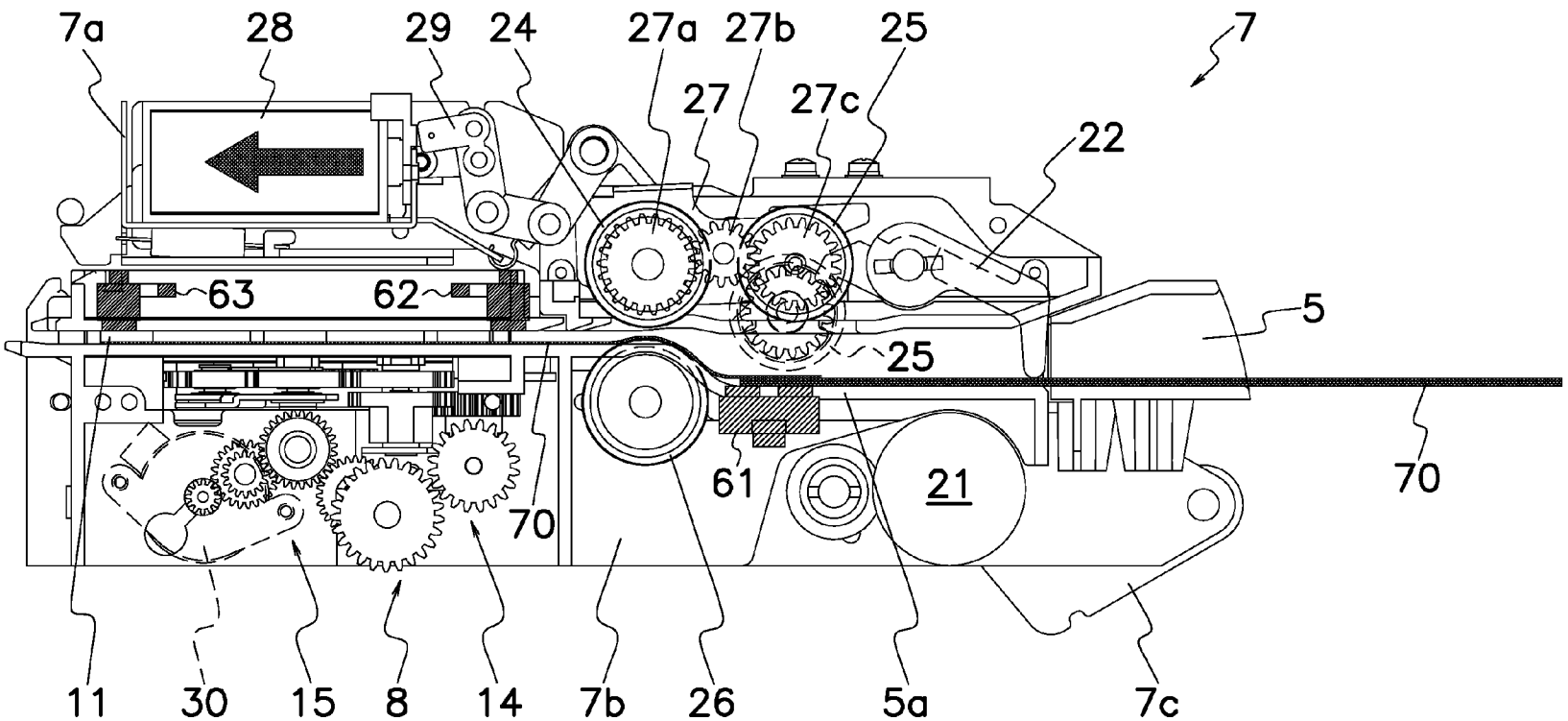
FIG. 9 A sectional view of the introduction device indicating the bracket in the inoperative position.

As is apparent from FIG. 4, introduction device 7 comprises an intake motor 21, a pinion 21*a* mounted on a rotation shaft of intake motor 21, a shutter 22 shown in FIG. 6 that can control insertion of an additional bill from bill inlet 5, a gear train 23 made up of first to twelfth gears 23*a* to 23*l* for sequentially transmitting drive power of pinion 21*a*, a feed roller 24 drivingly connected to intake motor 24 through first to sixth gears 23*a* to 23*f* and eighth and tenth gears 23*h* to 23*j* for rotation of feed roller 24 integrally with tenth gear 23*j*, an intake roller 25 drivingly connected to feed roller 24 through intermediate gear 27*b* shown in FIG. 6, a retard roller 26 drivingly connected to intake motor 21 through first to fifth gears 23*a* to 23*e* and seventh gear 23*g* in gear train 23 for integral rotation of retard roller 26 and seventh gear 23*g* so that retard roller 26 arrives at a power-swing damping to rotate in the adverse direction upon contact to feed roller 24, a bracket 27 shown in FIG. 6 for supporting a main drive gear 27*a* rotatable in unison with tenth gear 23*j*, an intermediate gear 27*b* meshed with main drive gear 27*a* and a follower gear 27*c* meshed with intermediate gear 27*b*, an actuator 28 for moving bracket 27 between the operative position shown in FIG. 6 and the inoperative position shown in FIG. 9, a linkage 29 for drivingly connecting bracket 27 and actuator 28, and an intake sensor 61 for detecting insertion of bill 70 into bill inlet 5. Bracket 27 also rotatably supports a feed roller 24 mounted on main drive gear 27*a*, an intake roller 25 mounted on follower gear 27*c* and an intermediate gear 27*b*. During forward (clockwise) rotation of intake motor 21, rotation force from pinion 21*a* is transmitted to twelfth gear 231 through first to sixth gears 23*a* to 23*f*, eighth and eleventh gears 23*h*, 23*k* in gear train 23 to rotate shutter 22 together with twelfth gear 231 in the clockwise arrowed direction of FIG. 6 so that shutter 22 closes bill inlet 5 to inhibit insertion of a subsequent bill through bill inlet 5. Upper unit 7*a* supports shutter 22, eighth to twelfth gears 23*h* to 23*l* of gear train 23, feed roller 24, intake roller 25, bracket 27, actuator 28 and linkage 29, and lower unit 7*b* supports intake motor 21, first to seventh gears 23*a* to 23*g* in gear train 23, retard roller 26 and intake sensor 61. Optical sensors such as photo-couplers are used in intake sensor 61 to optically detect existence of bill 70.

Figure 8:
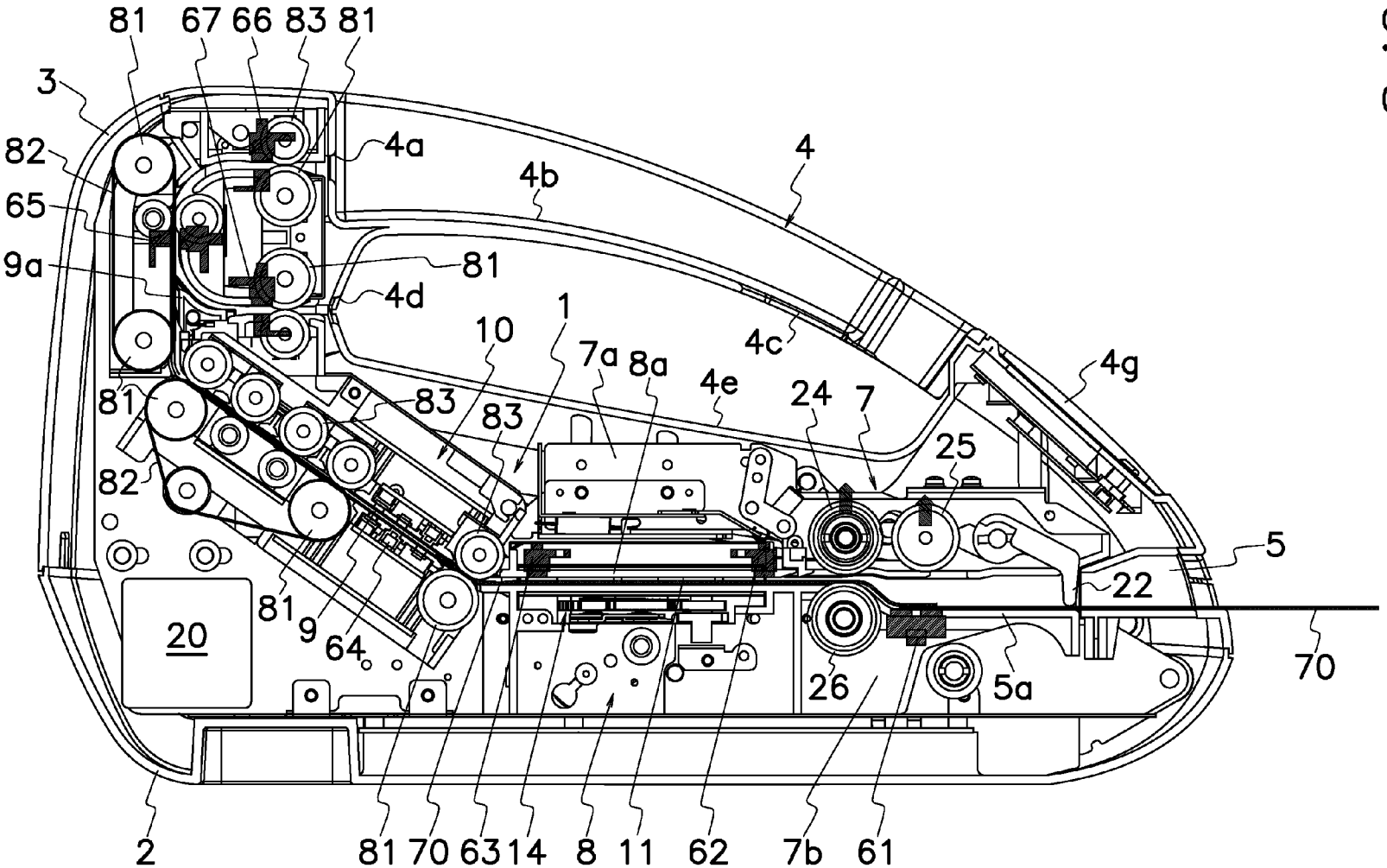
FIG. 8 A sectional view of the bill validator indicating intake rollers in the inoperative position.
Figure 10:
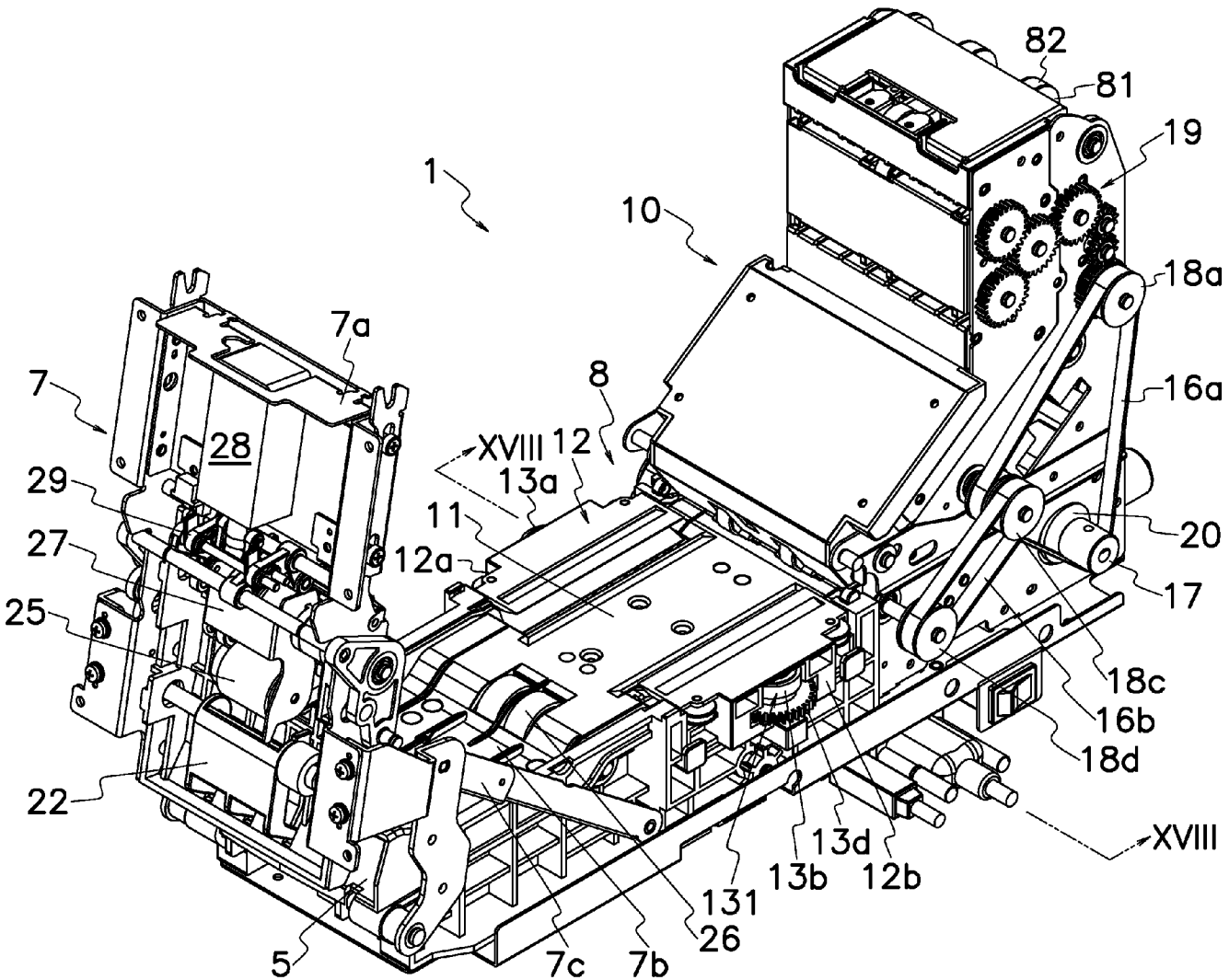
FIG. 10 A perspective view of a conveyor without a rotation bracket.
Figure 11:
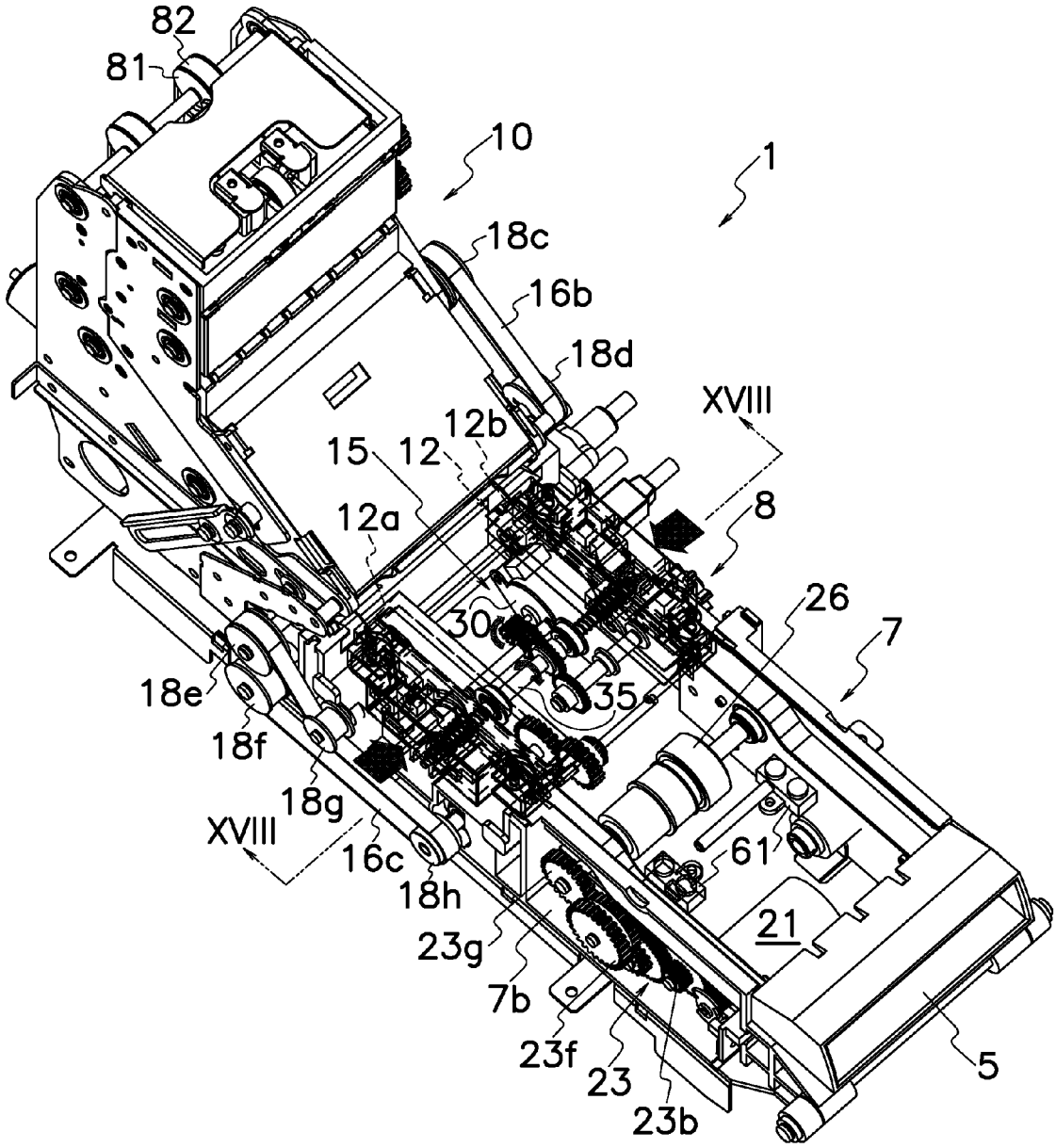
FIG. 11 A perspective view of the conveyor without the introduction device, a passageway and a transmission device for a pair of opposed rollers shown in FIG. 10.

As illustrated in FIG. 5, discharge device 10 comprises a single drive motor 20, a power transmission device made up of a drive roller 17 and first to eighth intervenient rollers 18*a* to 18*h* around which drive belts 16*a* to 16*c* are wound as shown in FIGS. 10 and 11 and a drive gearing 19, a plurality of convey rollers 81 and convey belts 82 for transporting bill 70 along rear passageway 9, and a plurality of pinch rollers 83 urged toward plurality of convey rollers 81 and convey belts 82 to grasp bill 70 therebetween. Drive motor 20 serves to rotate a plurality of convey rollers 81 in discharge device 10 through drive belts 16*a* to 16*c*, first to eighth intervenient rollers 18*a* to 18*h* and drive gearing 19, utilizing rotation of drive roller 17 mounted on a rotation shaft directly connected to a rotor in drive motor 20. Also, drive motor 20 works to drive transmission device 14 in transport device 8 to rotate opposed rollers 131 as opposed rotators. Arranged along rear passageway 9 are a validation sensor 64, a deflector 9*a*, a validation finish sensor 65, an upper outlet sensor 66 and a lower outlet sensor 67. Validation sensor 64 comprises a plurality of optical and magnetic sensors not shown for converting optical and magnetic features of bill 70 moving through rear passageway 9 into electric detection signals to control device 60 shown in FIG. 22. A deflector 9*a* shown in FIGS. 5 and 8 is resiliently urged in the counterclockwise direction by a built-in bias-spring not shown to bring deflector 9*a* into contact to an outer (left) surface of rear passageway 9. When bill 70 is moved along rear passageway 9 toward an upper outlet 4*a*, bill 70 forcibly rotates deflector 9*a* in the clockwise direction against resilient force of bias-spring so that deflector 9*a* rotates inwardly (rightward) of rear passageway 9 to pass bill 70 by deflector 9*a*. All of validation finish sensor 65, upper and lower outlet sensors 66, 67 comprise optical sensors such as photo-couplers to detect passage of a trailing edge of bill 70.

Figure 14:
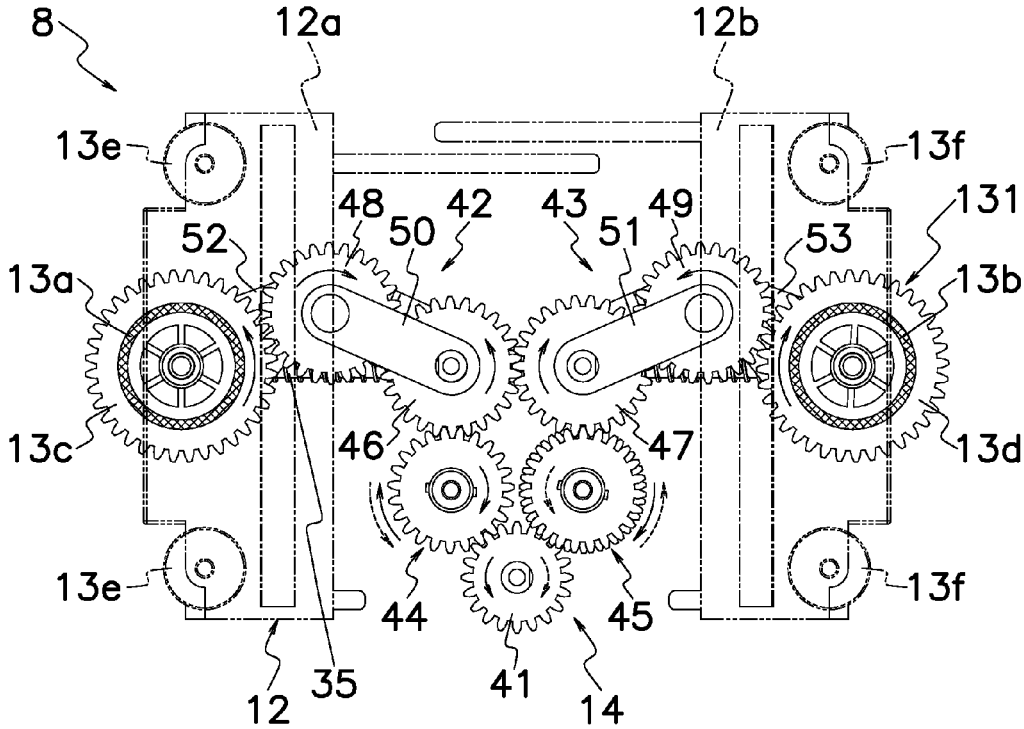
FIG. 14 A plan view of a pair of opposed rollers in the farthest positions.
Figure 15:
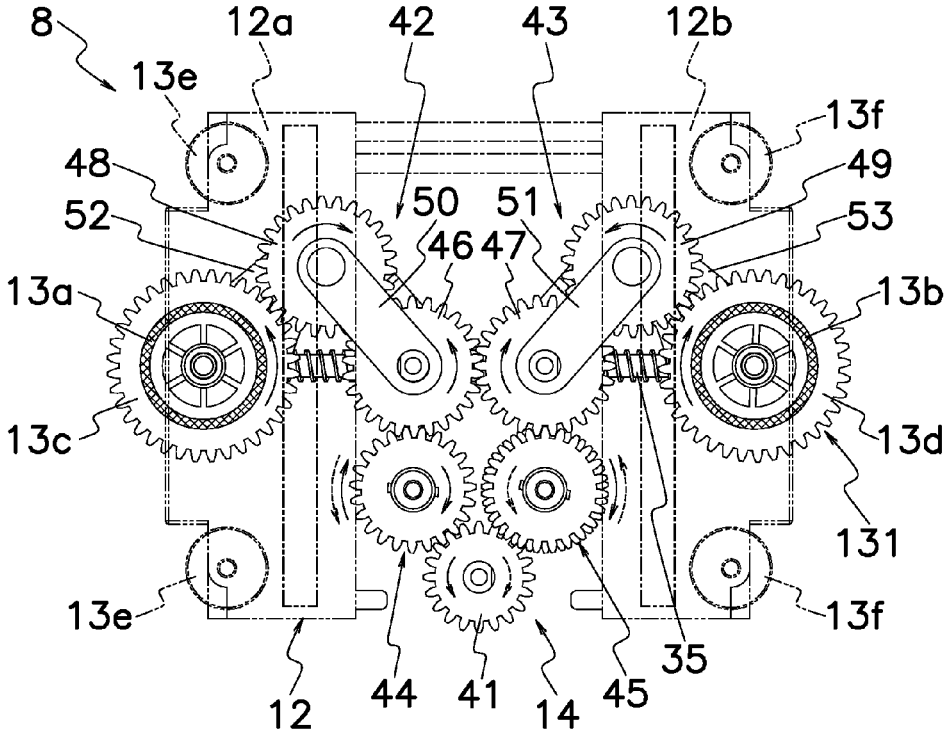
FIG. 15 A plan view of a pair of opposed rollers in the nearest positions.

As is apparent from FIGS. 10 to 17, transport device 8 comprises first and second bearing blocks 12*a*, 12*b* collectively referred to as "bearing blocks 12", first and second opposed rollers 13*a*, 13*b* collectively referred to as "opposed rotators 131" rotatably supported on respectively first and second bearing blocks 12*a*, 12*b*, a transmission device 14 for drivingly connecting drive motor 20 to first and second rollers 13*a*, 13*b*, and a centering device 15 for moving first and second bearing blocks 12*a*, 12*b* toward and away from each other transversely or perpendicularly to a longitudinal direction of front passageway 11. Bearing blocks 12 each have a channel-shaped section and are disposed on the opposite sides of front passageway 11 for movement of bearing blocks 12 toward and away from each other at right angle to the lengthwise direction of front passageway 11. As shown in FIGS. 3, 5 and 8, a rotation bracket 8*a* is provided over front passageway 11 and bearing blocks 12; an centering finish sensor 62 is arranged at an inlet end of rotation bracket 8*a* for detecting passage of a trailing edge of centralized bill 70; and an intake finish sensor 63 is located at an outlet end of rotation bracket 8*a* for detecting passage of a leading edge of bill 70 moved to the rear of front passageway 11. Centering and intake finish sensors 62, 63 may each comprise an optical sensor such as a photo-coupler. As seen in FIGS. 14 and 15, a pair of first auxiliary rollers 13*e* before and behind first opposed roller 13*a* are rotatably supported on first bearing block 12, and likewise, a pair of second auxiliary rollers 13*f* before and behind second opposed roller 13*b* are rotatably supported on second bearing block 12 to bring first and second auxiliary rollers 13*e* and 13*f* into contact to side edges of bill 70 before and behind first and second opposed rollers 13*a* and 13*b* to thereby prevent tilt of central axis C of bill 70 relative to central axis G of front passageway 11. Opposed rollers 13*a* and 13*b* each have an outer surface roughened or coated with for example elastic rubbery resin to strengthen frictional or gripping force by outer surface to side edges of bill 70.

As shown in FIGS. 12 to 15, transmission device 14 comprises a drive gear 41 rotated by drive motor 20, a first epicyclic gear train 42 for transmitting drive power from drive gear 41 to first opposed roller 13*a*, and a second epicyclic gear train 43 for transmitting divided drive power from first epicyclic gear train 42 to second opposed roller 13*b*. In other words, first and second epicyclic gear trains 42, 43 provide a drive power divider for splitting rotational force from drive gear 41 between first and second opposed rollers 13*a* and 13*b*. First epicyclic gear train 42 comprises a first control gear train 44 that has a first main gear 44*a* meshed with drive gear 41 and a first follower gear 44*b* rotated integrally with a first main gear 44*a* only in the arrowed direction in solid lines, a first sun gear 46 meshed with first follower gear 44*b* of first control gear train 44, a first epicyclic gear 48 engaged with first sun gear 46 and first final gear 13*c* to rotate first epicyclic gear 48 about first sun gear 46, a first link 50 for linking rotation shafts of first sun gear 46 and first epicyclic gear 48 to rotate first link 50 about rotation shaft of first sun gear 46, and a first final link 52 (FIGS. 14 and 15) for linking rotation shafts of first epicyclic gear 48 and first final gear 13*c* to rotate first final link 52 about rotation shaft of first epicyclic gear 48. First final gear 13*c* may rotate integrally with first opposed roller 13*a*. Second epicyclic gear train 43 comprises a second control gear train 45 that has a second main gear 45*a* meshed with drive gear 41 and a first follower gear 44*b* rotated integrally with a second main gear 45*a* only in the arrowed direction in dotted lines, a second sun gear 47 meshed with second follower gear 45*b* of second control gear train 45, a second epicyclic gear 49 engaged with second sun gear 47 and second final gear 13*d* to rotate second epicyclic gear 49 about second sun gear 47, a second link 51 for linking rotation shafts of second sun gear 47 and second epicyclic gear 49 to rotate second link 55 about rotation shaft of second sun gear 47, and a second final link 53 (FIGS. 14 and 15) for linking rotation shafts of second epicyclic gear 49 and second final gear 13*d* to rotate second final link 53 about rotation shaft of second epicyclic gear 49. Second final gear 13*d* may rotate integrally with second opposed roller 13*b*.

Figure 12:
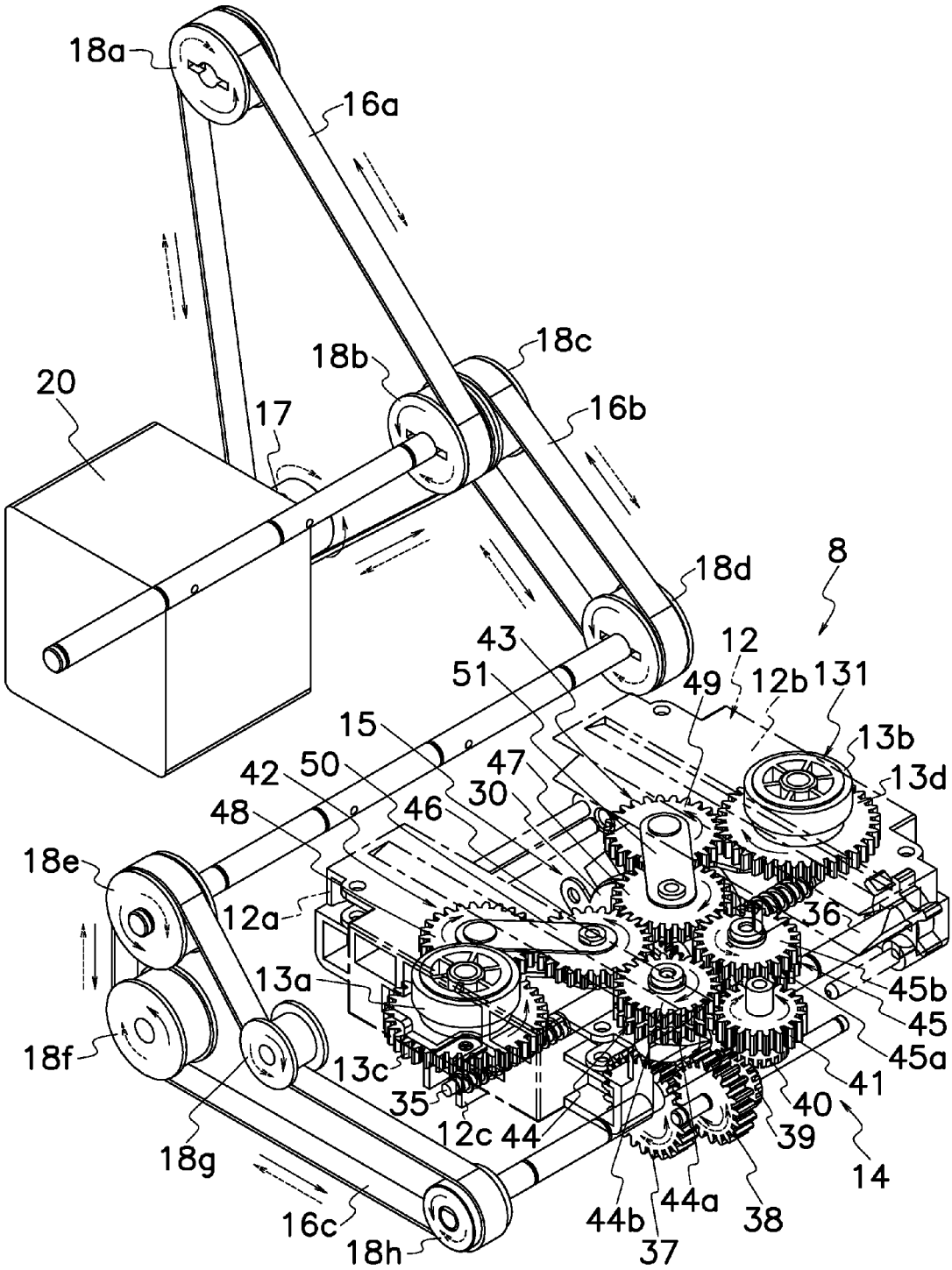
FIG. 12 A perspective view showing an interlocked configuration of the transmission device and a centering device.
Figure 13:
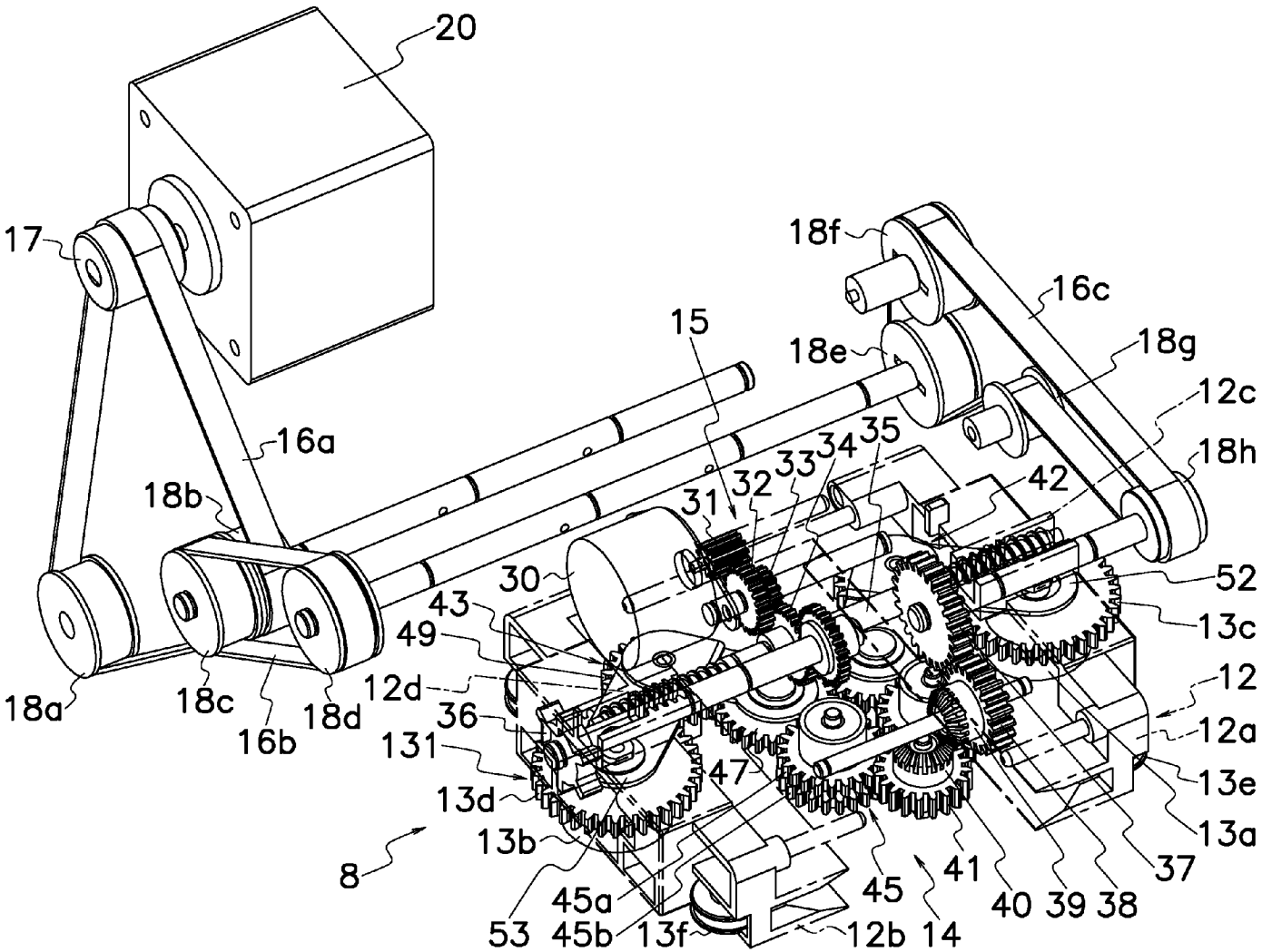
FIG. 13 A bottom perspective view of the transmission and centering devices.

During operation of transmission device 14 shown in FIG. 12, when drive motor 20 rotates in the arrowed forward direction in solid line to rotate drive roller 17 and first to eighth intervenient rollers 18*a* to 18*h* in the arrowed direction in solid lines, each of drive belts 16*a* to 16*c* runs in the arrowed direction in solid lines to rotate in turn eighth intervenient roller 18*h*, large gear 37 connected to eighth intervenient roller 18*h* and small gear 38 connected to large gear 37 in the arrowed directions in solid lines. Rotational force of small gear 38 in a vertical plane is converted into one in a horizontal plane via first and second bevel gears 39 and 40 to rotate drive gear 41 integrally with second bevel gear 40 in the arrowed direction in solid line. Driving power of drive gear 41 is transmitted to first and second main gears 44*a* and 45*a* of first control gear train 44 to rotate first follower gear 44*b* along with first main gear 44*a* in the arrowed directions in solid lines while idles second main gear 45*a* with respect to second follower gear 45*b*. For this idle run of second main gear 45*a*, a one way clutch not shown is mounted in second follower gear 45*b* while drive gear 41 is always interlocked with second main gear 45*a*. This ensures rotation of first sun gear 46 in first epicyclic gear train 42 in the arrowed direction in solid line and also rotation of first opposed roller 13*a* in the arrowed direction in solid line integrally with first final gear 13*c* through first epicyclic gear 48. Simultaneously, second sun gear 47 in second epicyclic gear train 43 is rotated in the arrowed direction in solid line because it is engaged with first sun gear 46, and also, second opposed roller 13*b* is rotated in the arrowed direction in solid line integrally with second final gear 13*d* through second epicyclic gear 49. Thus, this arrangement can utilize only a single drive motor 20 to rotate first and second opposed roller 13*a* and 13*b* in the adverse direction each other at the same rate of rotation through first and second epicyclic gear trains 42 and 43. To the contrary, when drive motor 20 rotates in the arrowed inverse direction in dotted line to rotate drive roller 17 and first to eighth intervenient rollers 18*a* to 18*h* in the arrowed direction in dotted lines, each of drive belts 16*a* to 16*c* runs in the arrowed direction in dotted lines to rotate in turn eighth intervenient roller 18*h*, large gear 37, small gear 38 and drive gear 41 via first and second bevel gears 39 and 40 in the arrowed direction in dotted line. In this case, second follower gear 45*b* rotates integrally with second main gear 45*a* in the arrowed direction in dotted line, while idles first main gear 44*a* with respect to first follower gear 44*b*. For this idle run of first main gear 44*a*, a one way clutch not shown is mounted in first follower gear 44*b*. Accordingly, this gearing can achieve rotations of first and second epicyclic gear trains 42 and 43 and first and second opposed rollers 13*a* and 13*b* in the same direction as that during the forward rotation of drive motor 20. Thus, the gearing can rotate first and second opposed rollers 13*a* and 13*b* always in the same direction at the constant rate of rotation independently of the rotational direction of drive motor 20.

Figure 16:
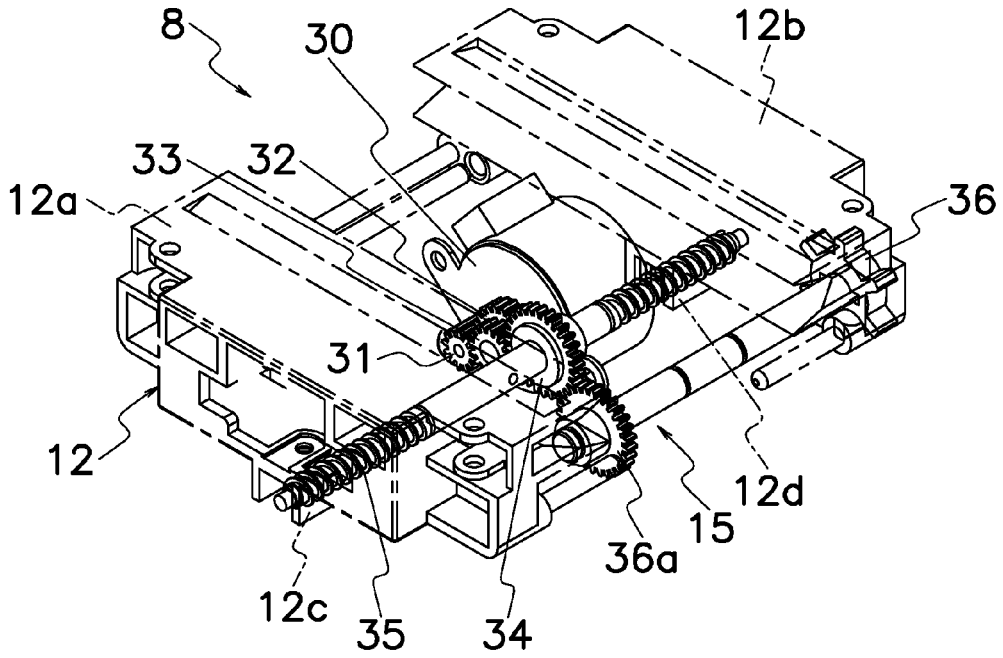
FIG. 16 A perspective view of a centering device.
Figure 17:
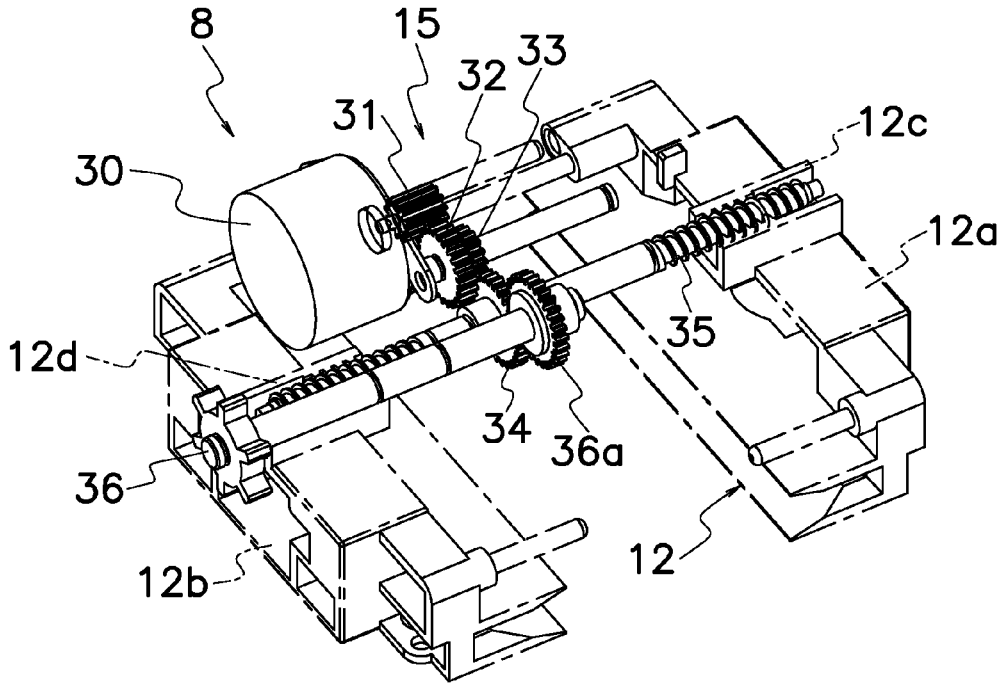
FIG. 17 A bottom perspective view of the centering device.

As shown in FIGS. 16 and 17, centering device 15 comprises a centering motor 30, a pinion 31 mounted on a rotation shaft of centering motor 30, an intermediate large gear 32 engaged with pinion 31, an intermediate small gear 33 formed integrally with intermediate large gear 32, a shaft gear 34 meshed with intermediate small gear 33, and a feed shaft 35 secured to shaft gear 34 and having a pair of external screws in threaded engagement with internal screws formed in pedestals 12*c* and 12*d* of first and second bearing blocks 12*a* and 12*b*. Also, a centering gear 36*a* is mounted on a release shaft 36 to engage with shaft gear 34 so that during the inactive condition of centering motor 30, release shaft 36 may be manually rotated to rotate shaft gear 34 mounted on feed shaft 35 to move first and second bearing blocks 12*a* and 12*b* away from each other. Internal screws in pedestals 12*c* and 12*d* of first and second bearing blocks 12*a* and 12*b* are formed in the adverse direction each other. Likewise, external screws on feed shaft 35 are formed in the adverse direction each other. When centering motor 30 rotates in the forward direction, power transmission device 31 to 35 rotates in the forward direction that comprises pinion 31, intermediate large gear 32, intermediate small gear 33, shaft gear 34 and feed shaft 35. Rotation of external screws on feed shaft 35 causes pedestals 12*c* and 12*d* of first and second bearing blocks 12*a* and 12*b* to move toward each other along external screws on feed shaft 35 due to engagement of internal screws of first and second bearing blocks 12*a* and 12*b*. To the contrary, when centering motor 30 rotates in the adverse direction, first and second bearing blocks 12*a* and 12*b* are moved away from each other through power transmission device 31 to 35.

Figure 18:
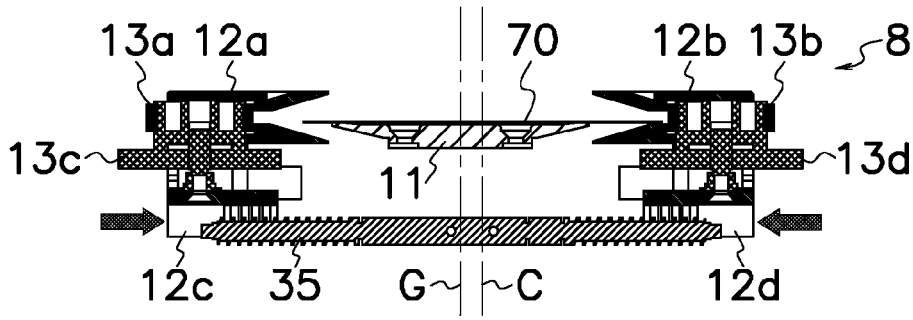
FIG. 18 A sectional view of a transport device in the farthest positions taken along a line XVIII-XVIII in FIGS. 10 and 11.
Figure 19:
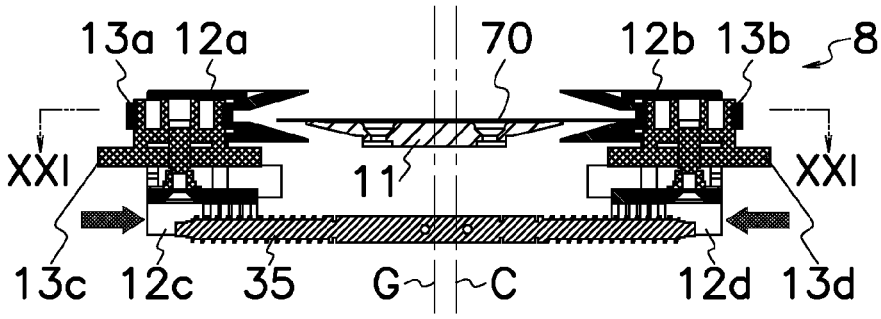
FIG. 19 A sectional view of the transport device indicating a bill of one side edge in contact to one of opposed rollers.
Figure 20:
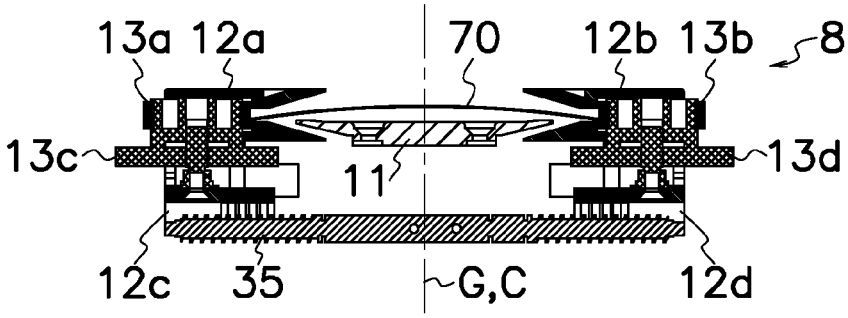
FIG. 20 A sectional view of the transport device indicating the bill centered by the opposed rollers.
Figure 21:
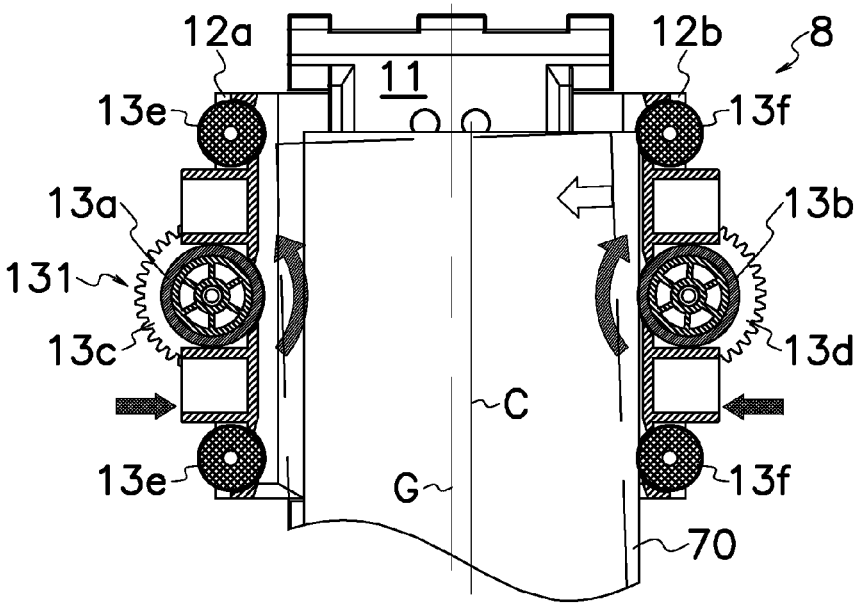
FIG. 21 A sectional view taken along a line XXI-XXI in FIG. 19.

As shown in FIG. 18, when bill 70 is transported through front passageway 11 in the rightward displaced condition of central line C of bill 70 from central line G of front passageway 11 in transport device 8, drive motor 20 is rotated, and at the same time, centering motor 30 is driven. This enables to move first and second bearing blocks 12*a* and 12*b* toward each other in the opposing thick-arrowed directions from the farthest position shown in FIG. 14 to the nearest position shown in FIG. 15 while rotating first and second opposed rollers 12*a* and 12*b* through transmission device 14; to rotate first and second links 50 and 51 respectively in first and second epicyclic gear trains 42 and 43 about first and second sun gears 46 and 47 in the opposite directions to each other; and moreover to rotate first and second final links 52 and 53 about rotation axes of first and second epicyclic gears 48 and 49 in the opposite directions each other. Therefore, first and second opposed rollers 13*a* and 13*b* are rotated in the opposing thick-arrowed directions each other shown in FIG. 21 at the same rate of rotation, and concurrently, first and second bearing blocks 12*a* and 12*b* are moved toward each other for centering so that this approach movement of first and second bearing blocks 12*a* and 12*b* reduces both pitch distances between rotation shafts of first sun gear 46 and first opposed roller 13*a* and between rotation shafts of second sun gear 47 and second opposed roller 13*b* by the same moved length. In this case, if right side edge of bill 70 is in contact to second opposed roller 13*b* and two second auxiliary rollers 13*f* as shown in FIGS. 19 and 21, right side edge of bill 70 on front passageway 11 is pushed leftward by second opposed roller 13*b* as shown in FIG. 21. So, if bill 70 is moved leftward, left side edge of bill 70 is in contact to and pushed rightward by first opposed roller 13*a*. Finally, rotating first and second opposed rollers 13*a* and 13*b* is simultaneously brought into contact to both side edges of bill 70 as shown in FIG. 20 to grasp both side edges of bill 70 between first and second opposed rollers 13*a* and 13*b* and to bring center line C of bill 70 into alignment with center line G of front passageway 11. In this case, bill 70 is grasped with a shorter distance than width of bill 70 between first and second opposed rollers 13*a* and 13*b* approaching each other so that bill 70 becomes deformed into a slightly arcuate shape shown in FIG. 20 against its own elasticity, and so rotational force of rotators 131, 132 applied to bill 70 serves to flip, flick or push bill 70 at an accelerated rate to the rear of passageway 11 in the tangential direction of rotating first and second opposed rollers 13*a* and 13*b*. Then, when validation sensor 64 detects leading edge of bill 70, centering motor 30 is rotated in the adverse direction to move first and second bearing blocks 12*a* and 12*b* from the nearest position in FIG. 15 to the farthest position in FIG. 14. In this way, the device can continuously and at a high rate of speed, transport, grasp, center and flip bill 70 further inwardly of front passageway 11 by rotating first and second opposed rollers 13*a* and 13*b* to accelerate transporting speed of bill 70.

Figure 22:
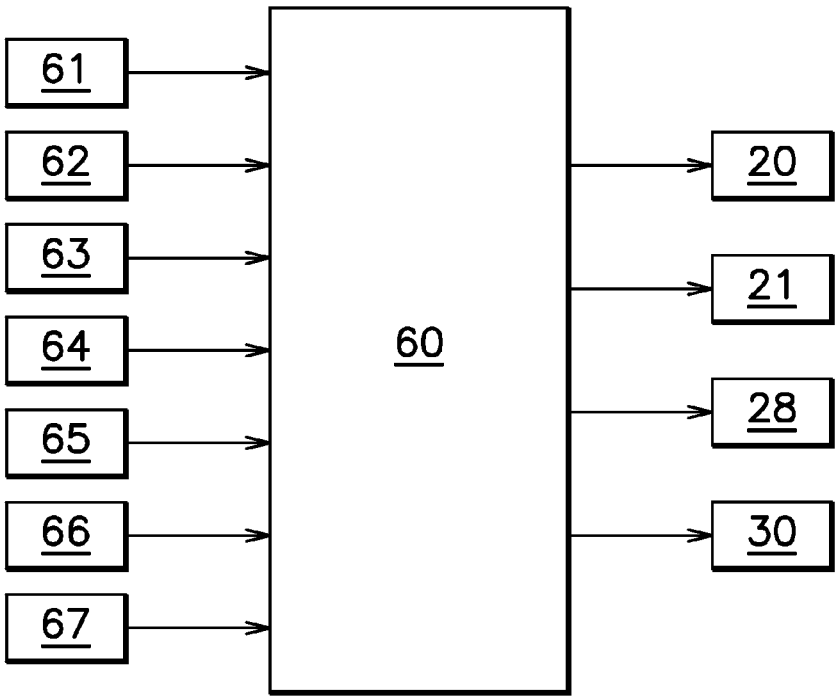
FIG. 22 An electric circuit diagram of the bill validator shown in FIG. 1.

Conveyor 1 has control device 60 shown in FIG. 22 that has input terminals electrically connected to intake sensor 61, centering finish sensor 62, intake finish sensor 63, validation sensor 64, validation finish sensor 65, upper outlet sensor 66 and lower outlet sensor 67, and output terminals electrically connected to drive motor 20, centering motor 30, actuator 28 and intake motor 21. Control circuit 60 may comprise program-controlled one-chip microcomputer or integrated circuits designed to receive detection signals indicative of physical features of bill 70 at input terminal from validation sensor 64 to discriminate authenticity of bill 70. Control circuit 60 also receives detection signals at input terminals from various sensors 61 to 63 and 65 to 67 other than validation sensor 64 to produce at output terminals program-controlled output signals in accordance with received detection signals to drive intake motor 21 in introduction device 7, actuator 28, centering motor 30 in transport device 8 and drive motor 20 in discharge device 10.

Figure 23:
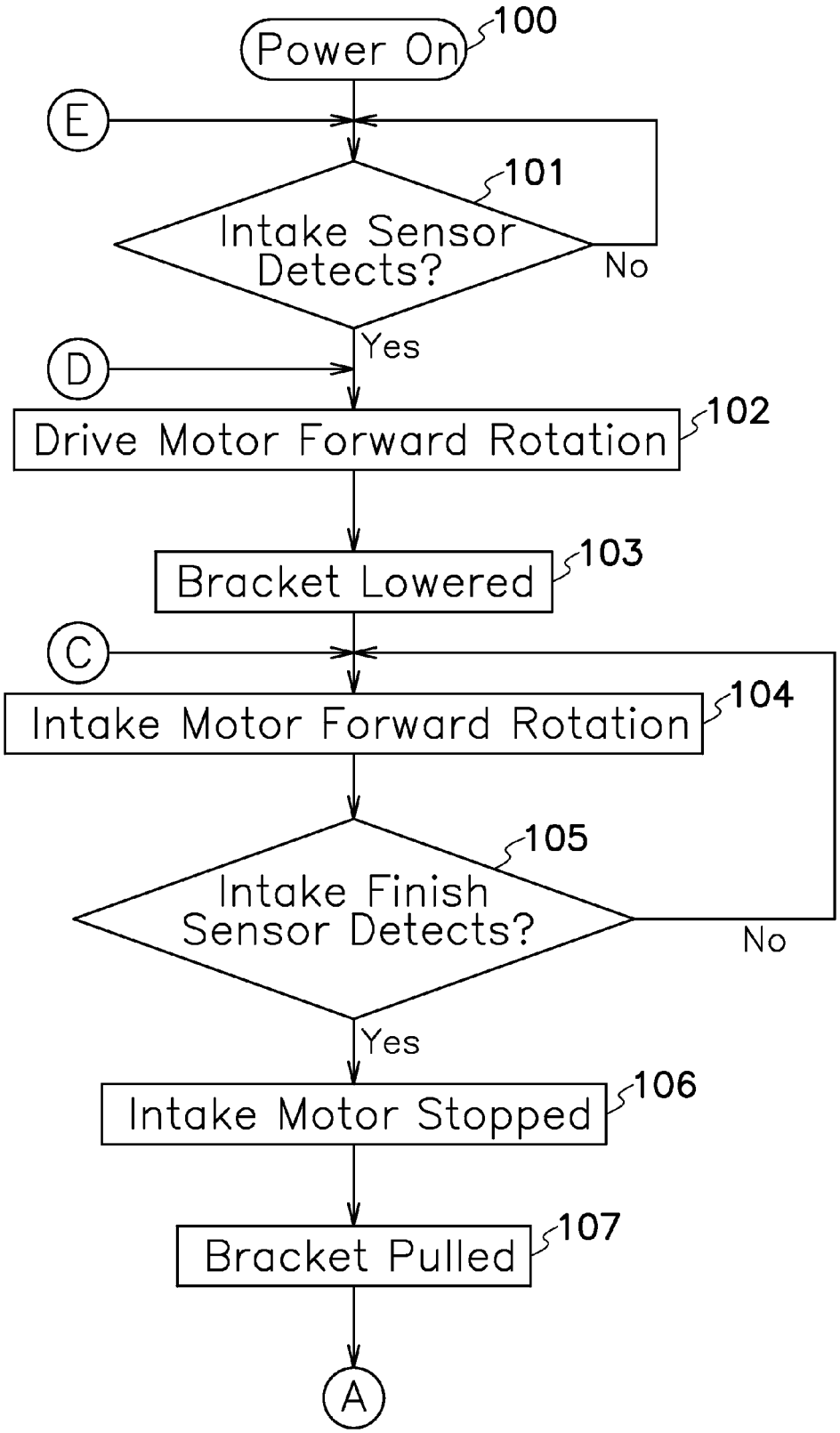
FIG. 23 A flow chart indicating an operational sequence of the bill validator shown in FIG. 1.
Figure 24:
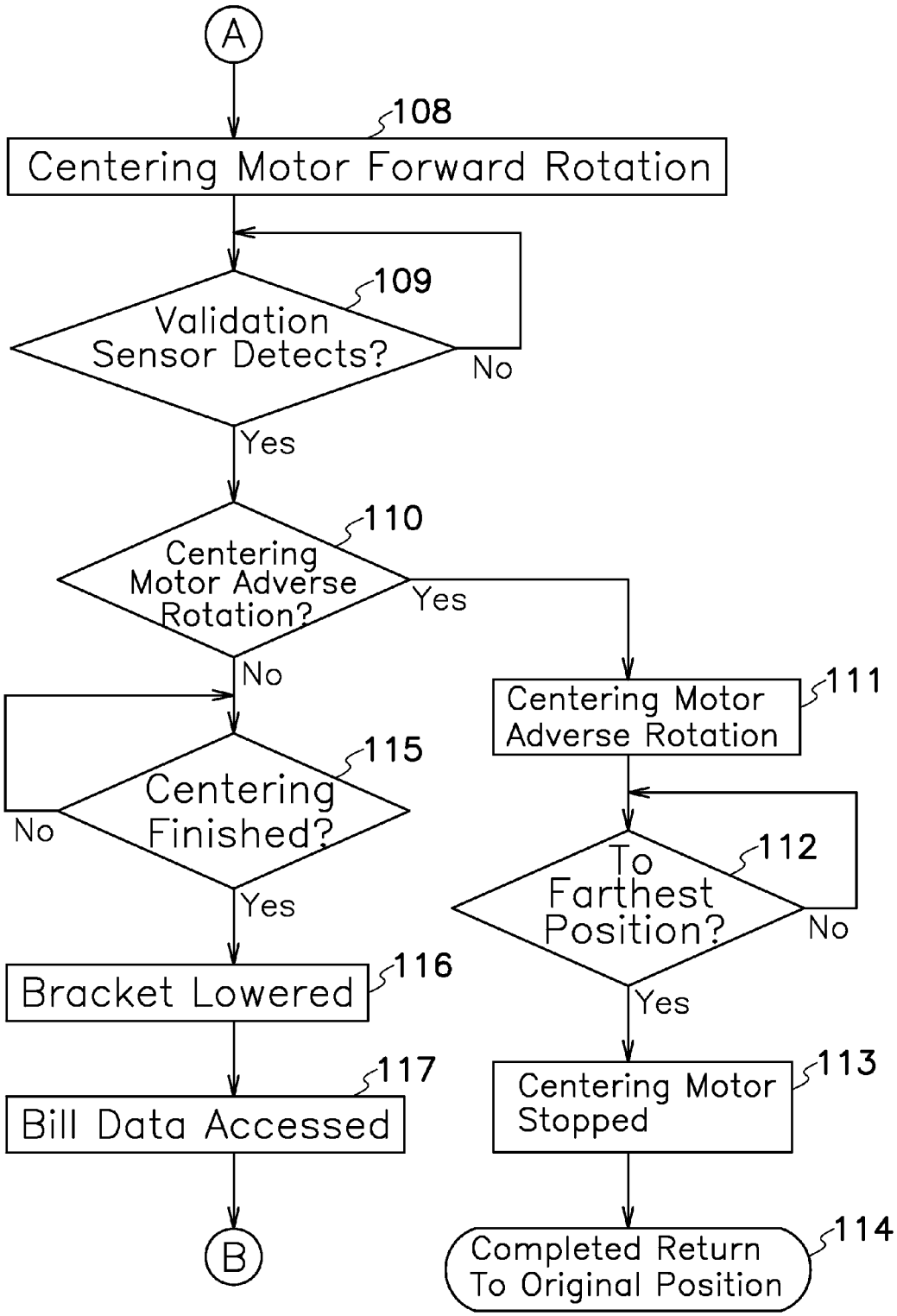
FIG. 24 An additional flow chart indicating an additional operational sequence following that shown in FIG. 23.
Figure 25:
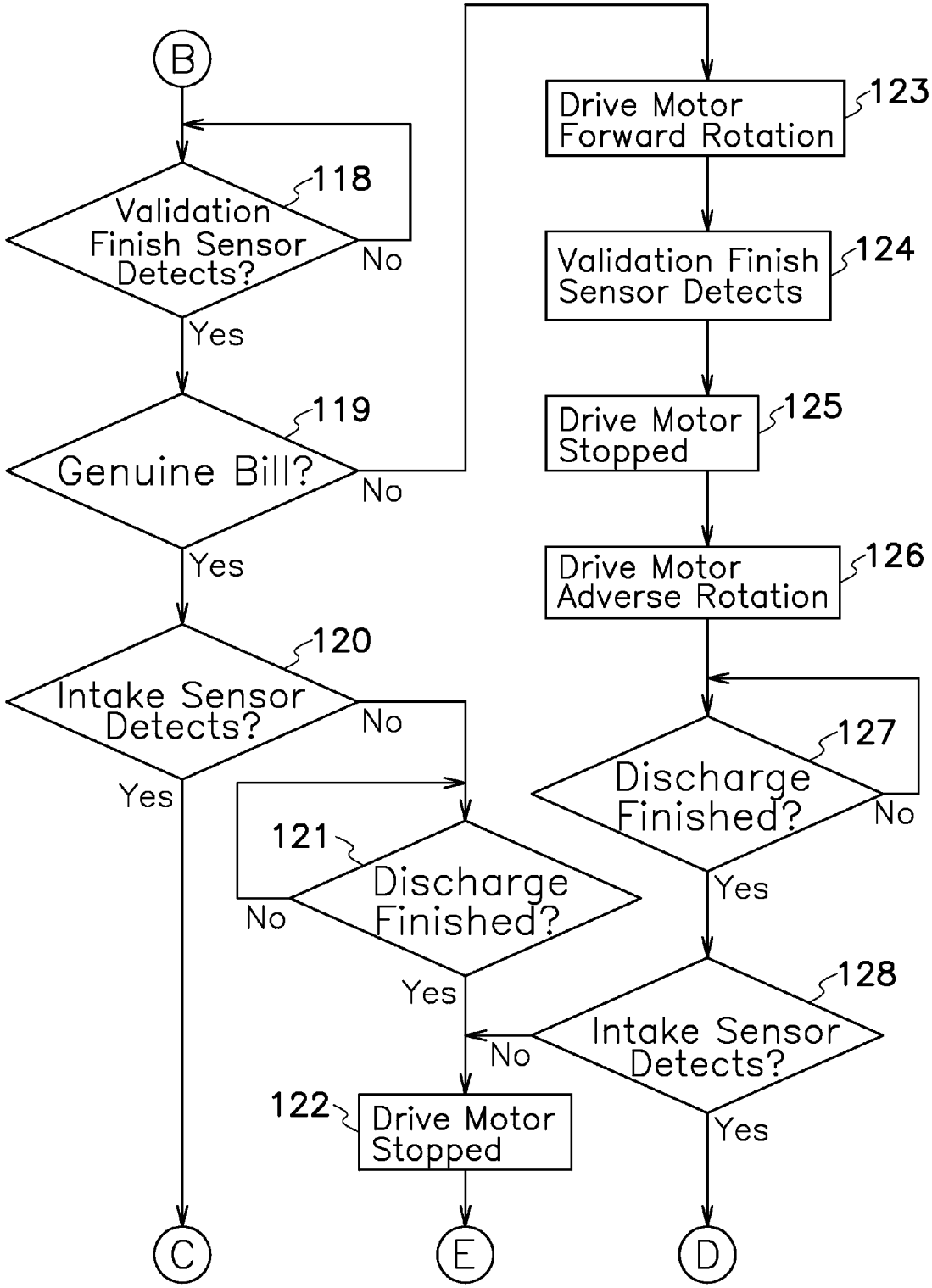
FIG. 25 A further flow chart indicating a further operational sequence following that shown in FIG. 24.

The bill validator in the embodiment according to the present invention is driven under the operational sequences in flow charts shown in FIGS. 23 to 25. In Step 100 of FIG. 23, electric power is supplied, and then, in Step 101, control device 60 decides whether or not intake sensor 61 in introduction device 7 detects insertion of bill 70 into bill inlet 5, and if intake sensor 61 detects no insertion, the processing remains in Step 101. When detects the insertion, intake sensor 61 produces a detection signal to control device 60 that then activates drive motor 20 for the forward rotation in Step 102 to thereby energize discharge device 10 and rotate first and second opposed rollers 13*a* and 13*b* in transport device 8. Then, the processing moves on to Step 103 where control device 60 operates actuator 28 shown in FIG. 6 to move bracket 27 downward and bring intake roller 25 into contact to bill 70. Subsequently, the processing goes on to Step 104 where control device 60 is operated to drive intake motor 21 for the forward rotation in introduction device 7 shown in FIG. 4; to rotate feed roller 24 in the arrowed direction of FIG. 5 through first to sixth gears 23*a* to 23*f* and eighth to tenth gears 23*h* to 23*j* in gear device 23; and further to rotate intake roller 25 in the arrowed direction of FIG. 5 through intermediate gear 27*b* of FIG. 6. At the same time, bracket 27 shown in FIG. 6 is rotated in the clockwise direction to move to the operative position, and shutter 22 is rotated in the clockwise direction to close bill inlet 5 to inhibit insertion of subsequent bill through bill inlet 5. During retention of bracket 27 in the operative position shown in FIG. 6, bill 70 is grasped between intake roller 25 in the operative position and inlet tray 5*a*, and conveyed inwardly with rotation of intake roller 25 to further grasp bill 70 between feed roller 24 in upper unit 7*a* and retard roller 26 in lower unit 7*b*. Feed roller 24 is rotated in the forward or clockwise direction to convey bill 70 inwardly of passageway 11, and retard roller 26 is rotated in the clockwise direction through a torque limiter not shown that restricts and controls torque of retard roller 26 less than the force level of rotational power by feed roller 24. If a sheet of bill 70 grasped between feed and retard rollers 24 and 26, bill 70 is normally conveyed inwardly through front passageway 11 because retard roller 26 is overcome by rotational power of feed roller 24, arrives at a power-swing damping and rotates in the counterclockwise adverse direction shown in FIG. 6 to continuously convey uppermost bill 70 inwardly of front passageway 11. However, when a stack of bills 70 is grasped between feed and retard rollers 24 and 26, rotational power by feed roller 24 is transmitted to only an uppermost bill 70 which is then conveyed inwardly, and underlaid bill or bills 70 other than uppermost one are returned by rotation of retard roller 26 toward bill inlet 5 due to less friction force between uppermost and underlaid bills 70. After that, transport force that feed roller 24 applies to uppermost bill 70 through frictional force is greater than drive torque of retard roller 26. For that reason, bill 70 returned toward bill inlet 5 is successively inwardly transported. Subsequently, the processing moves from Step 104 to 105 where control device 60 decides whether or not intake finish sensor 63 detects a leading edge of moved bill 70, and if not, the processing is returned to Step 104, in contrast, when intake finish sensor 63 detects leading edge of bill 70 as shown in FIG. 9, the processing goes on to Step 106 where control device 60 ceases drive of intake motor 21.

Thereafter, the processing moves on to Step 107 where control device 60 operates actuator 28 in the arrowed direction in FIG. 9 to pull in bracket 27 through linkage 29 so that bracket 27 is moved from the operative position shown in FIG. 6 to the inoperative position shown in FIG. 9 to separate feed and intake rollers 24 and 25 from bill 70 as shown in FIGS. 8 and 9. Then, the processing advances to Step 108 in FIG. 24 where control device 60 is operated to activate both drive and centering motors 20 and 30 in the forward direction to rotate first and second opposed rollers 13*a*, 13*b* in transport device 8 and also to cause first and second bearing blocks 12*a*, 12*b* to approach toward each other from the farthest position in FIG. 14 to the nearest position in FIG. 15 for alignment (centering) of bill 70. This enables to simultaneously bring first and second opposed rollers 13*a*, 13*b* during their rotation into contact to both side edges of bill 70 to grasp both side edges of bill 70 between first and second opposed rollers 13*a*, 13*b* and also to bring center line C of bill 70 into alignment with center line G of front passageway 11 (FIGS. 18 to 21), and also, rotational force of rotators 131, 132 applied to bill 70 serves to flip or flick bill 70 at an accelerated rate further inwardly of rear passageway 9 in the tangential direction of outer periphery in rotators 131, 132 in contact to opposite sides of bill 70. Accordingly, bill 70 is gripped between conveyor and pinch rollers 81 and 83 in the vicinity of an inlet in rear passageway 9 shown in FIG. 8 to continuously carry bill 70 inwardly along rear passageway 9. The process goes on from Step 108 to 109 where control device 60 determines whether or not validation sensor 64 catches leading edge of bill 70 passing through rear passageway 9, and if this is negative, the program-controlled processing remains in Step 109, and adversely, if validation sensor 64 catches it, the step goes on to Step 110. There, control device 60 considers whether or not centering motor 30 needs its adverse rotation, and if needed, it is operated to rotate centering motor 30 in the adverse direction in Step 111; first and second bearing blocks 12*a*, 12*b* are moved away from each other; and after movement to the farthest positions (the original positions) shown in FIG. 14 (Step 112), centering motor 30 is stopped (Step 113) to finish return action of first and second bearing blocks 12*a*, 12*b* (Step 114).

When control device 60 decides failure of adversely rotating centering motor 30 in Step 110, the step goes on to 115 where control device 60 decides whether or not centering finish sensor 62 detects trailing edge of centralized bill 70, and if negative, the processing remains in Step 115. When centering finish sensor 62 detects passage of trailing edge of bill 70 to produce a detection signal, the processing moves on to Step 116 where control device 60 operates actuator 28 to move downward feed and intake rollers 24 and 25 together with bracket 27 from the inoperative position in FIG. 9 to the operative position in FIG. 6. Subsequently, drive motor 20 in FIG. 5 is operated to drive convey rollers 81 and convey belts 82 to convey bill 70 through rear passageway 9. Upon passage of moved bill 70 through validation sensor 64, optical and magnetic features (data) of bill 70 are converted (sampled) into electric signals (Step 117) that are forwarded to control device 60. Further, the processing goes on to Step 118 in FIG. 25 where control device 60 decides whether or not validation finish sensor 65 in FIG. 5 detects passage of trailing edge of bill 70 moved, thrusting deflector 9*a* out of the way against resilient force of deflector 9*a*, and if this is negative, the processing remains in Step 118. When validation finish sensor 65 detects trailing edge of bill 70 in Step 118, the processing moves on to Step 119 where control device 60 processes electric signals indicative of optical and magnetic features of bill 70 from validation sensor 64 to discriminate authenticity of bill 70 passing through rear passageway 9.

When control device 60 decides bill 70 as genuine in Step 119, drive motor 20 drives conveyor rollers 81 and conveyor belts 82 in discharge device 10 to convey bill 70 along rear passageway 9 toward upper outlet 4*a* to proceed to Step 120 where control device 60 decides whether or not intake sensor 61 detects a second or further bill 70 at bill inlet 5. When intake sensor 61 detects second or further one, the processing returns to Step 104 to drive intake motor 21 in introduction device 7 shown in FIG. 6 for the forward rotation, and bill is transported inwardly along front passageway 11 by intake roller 25 rotating in the arrowed clockwise direction in FIG. 6. When intake sensor 61 detects neither second nor further bill 70 in Step 120 of FIG. 25, the processing moves on to Step 121 where control device 60 decides whether upper outlet sensor 66 adjacent to upper outlet 4*a* detects passage of bill 70. If this is negative, the processing remains in Step 121. When bill 70 passes upper outlet sensor 66 and is discharged from upper outlet 4*a*, it is thrown into upper tray 4*b* in upper cabinet 4. Then, an operator can insert his or her finger into a notch 4*c* to easily pull out genuine bill 70 in upper tray 4*b*. Following Step 121, after a given time course, the processing goes on to Step 122 where control device 60 ceases operation of drive motor 20, returning to Step 101 shown in FIG. 23.

When control device 60 decides bill 70 as false in Step 119 of FIG. 25, it further rotates drive motor 20 (Step 123) to transport bill 70 along rear passageway 9 in FIG. 8, and when trailing edge of bill 70 passes validation finish sensor 65, it produces a detection signal to control device 60 (Step 124). At the moment, control device 60 stops operation of drive motor 20 once in Step 125. Then, in Step 126, as deflector 9*a* has returned by its elastic force to the original position urged toward the outer surface of rear passageway 9, control device 60 activates drive motor 20 in the adverse direction to move trailing edge of bill 70 along deflector 9*a* toward lower outlet 4*b*. Subsequently, the step advances to Step 127 where control device 60 decides whether lower outlet sensor 67 adjacent to lower outlet 4*b* detects passage of bill 70, and when bill 70 does not pass lower outlet sensor 67, the processing remains in Step 127. When bill 70 passes lower outlet sensor 67 and is discharged from lower outlet 4*b*, it is received in lower tray 4*e* in upper cabinet 4. Now, operator can insert his or her finger into dent 4*f* to easily take away bill on lower tray 4*e*. Also, in Step 128, control device 60 decides whether or not intake sensor 61 detects two or more bills 70 at bill inlet 5, and if this is affirmative, the processing returns to Step 102 in FIG. 23 to rotate drive motor 20 in the forward direction. When intake sensor 61 detects no second or further bill 70, the step diverts to Step 122 where control device 60 ceases operation of drive motor 20 to proceed to Step 101 in FIG. 23. In this way, the bill validator according to this embodiment may grasp bill 70 between rotating opposed rollers 131 movable toward and away from each other to perform the aligning (centering) action and accelerated transportation at a time and at high rate of speed for dramatic reduction in processing time from insertion of bill 70 to validation and for improvement in processing speed and validation accuracy.

Figure 26:
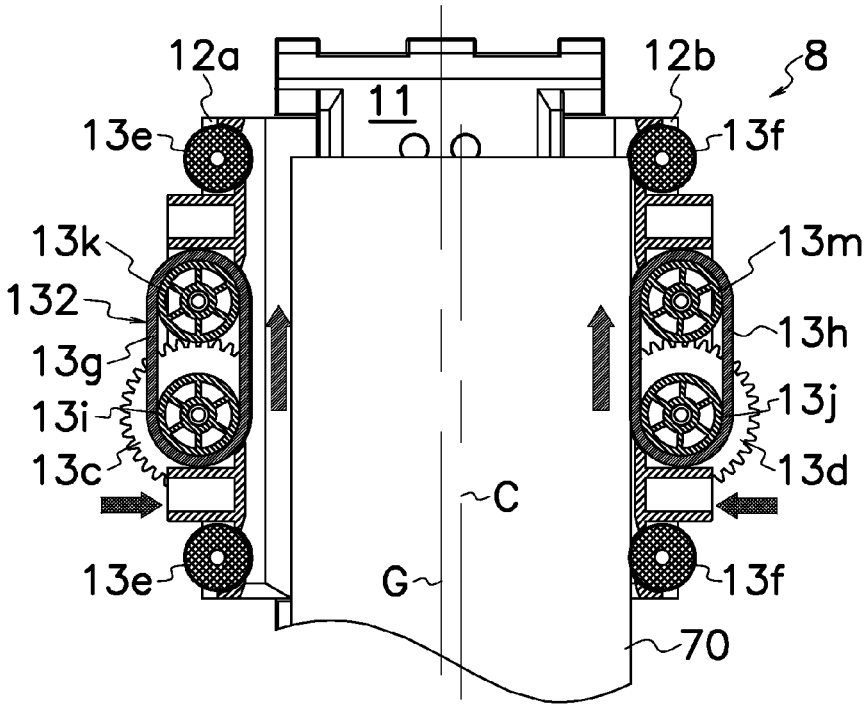
FIG. 26 A plan view of another embodiment according to the present invention utilizing a pair of opposed belts in lieu of opposed rollers.
Figure 27:
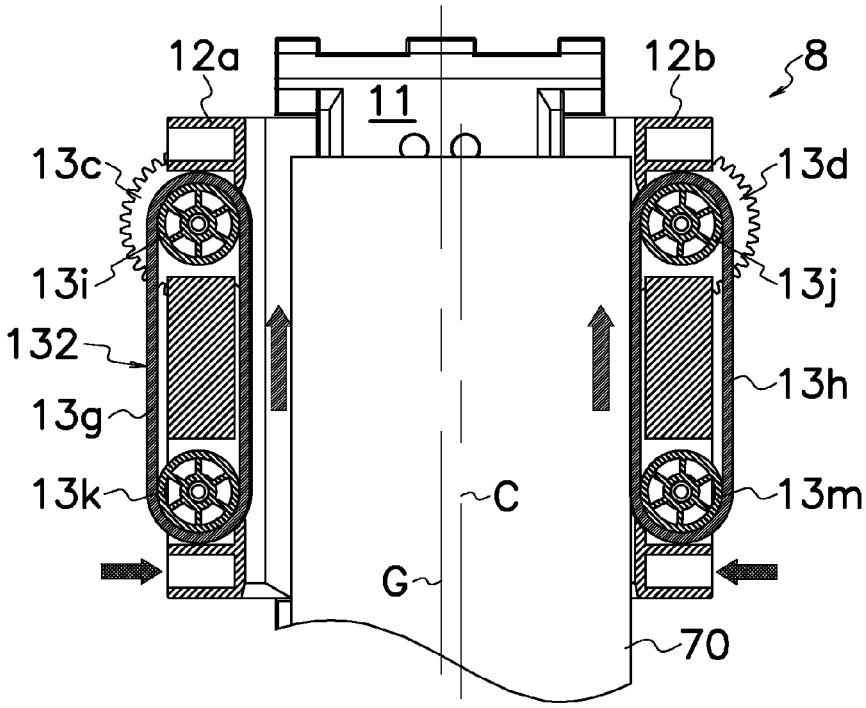
FIG. 27 A plan view of a further embodiment according to the present invention without auxiliary rollers.

The foregoing embodiments of the present invention may be changed or modified in various ways without limitation to the specified or shown examples. For instance, in lieu of opposed rollers 131, a pair of opposed belts 132 as shown in FIGS. 26 and 27 may be used that have first and second opposed belts 13*g* and 13*h*. In this case, as shown in FIG. 26, first bearing block 12*a* may comprise a drive pulley 13*i* and an idle pulley 13*k* and a first opposed belt 13*g* wound around drive and idle pulleys 13*i*, 13*k* so that drive pulley 13*i* can rotate integrally with first final gear 13*c*. Likewise, second bearing block 12*b* may comprise a drive pulley 13*j* and an idle pulley 13*m* and a second opposed belt 13*h* wound around drive and idle pulleys 13*j*, 13*m* so that drive pulley 13*j* can rotate integrally with second final gear 13*d*. Just like first and second opposed rollers 13*a*, 13*b*, first and second bearing blocks 12*a*, 12*b* may be moved toward and away from each other to grasp bill 70 between first and second opposed belts 13*g* and 13*h* to centralize bill 70 in front passageway 11 and accelerate it for transportation to the rear. FIG. 26 indicates a pair of auxiliary rollers 13*e* and 13*f* before and behind opposed belts 132 to prevent tilt of central axis C of bill 70 relative to central axis G of front passageway 11, however, in place of this structure, a pair of opposed belts 132 longer in a transport direction may be used to omit auxiliary rollers 13*e* and 13*f*. Also, if bill 70 can be conveyed with a pair of opposed rollers 131 only, auxiliary rollers 13*e* and 13*f* may of course be omitted. The foregoing embodiment indicates centering device 15 that comprises centering motor 30 and power transmission device 31 to 35 made up of pinion 31, intermediate large gear 32, intermediate small gear 33, shaft gear 34 and feed shaft 35 to convert rotational force of centering motor 30 into reciprocal driving force for bearing blocks 12. However, in lieu of centering motor 30 and power transmission device 31 to 35, a pair of linear motors may be used to simplify the structure in centering device 15. Also, the foregoing embodiment illustrates a mechanism for transmitting rotational force by drive motor 20 in discharge device 10 to drive gear 41 in transport device 8 through drive roller 17, drive belts 16*a* to

16*c* and first through eighth intervenient rollers 18*a* to 18*h*, however, instead, drive gear 41 may directly be driven by a dedicated motor.

INDUSTRIAL APPLICABILITY

This invention is effectively applicable to all and any devices for concentrically transporting documents such as coupons, valuable securities, tickets or other various documents other than bills.

The invention claimed is:

1. A device for concentrically transporting documents, comprising:

a pair of opposed rotators mounted on the opposite sides of a passageway for their rotation and movement in the transverse direction to a longitudinal direction of the passageway, a drive motor for rotating the rotators in the counter directions at the same rate of rotation, a centering motor for moving the rotators in the transverse direction to a longitudinal direction of the passageway, an intake finish sensor for detecting a leading edge of a document moved to the rear of the passageway, and a validation sensor for converting physical features of the document into electric detection signals, wherein after the intake finish sensor detects the leading edge of the document, both the drive and centering motors are activated to rotate the pair of the rotators and also to cause the rotators to approach toward each other, thereby, the rotators during their rotation are bought into contact to and grasp both side edges of the document to bring a center line of the document into alignment with a center line of the passageway, and to flick the document in the tangential direction of the outer periphery in the rotators, when the validation sensor detects a leading edge of the document, the centering motor is rotated in the adverse direction to move the rotators away from each other.

2. The device of claim 1, wherein the pair of the rotators comprise opposed rollers or opposed belts.

3. The device of claim 1, further comprising a pair of bearing blocks mounted on the opposite sides of the passageway, the bearing blocks being movable towards and away from each other in the transverse direction to the longitudinal direction of the passageway by operation of the centering motor, wherein the bearing blocks rotatably supports the rotators.

4. The device of claim 3, wherein the centering motor is rotated in the adverse direction to move the pair of the bearing blocks from the nearest position to the farthest position when the validation sensor detects the leading edge of the document.

5. The device of claim 3, further comprising auxiliary rollers rotatably mounted in each of the bearing blocks at the back and front of the rotators.

6. The device of claim 1, further comprising a transmission device for drivingly connecting the pair of the rotators to the single drive motor, wherein the transmission device comprises a power divider for sharing a rotational force from the drive motor between the rotators.

7. The device of claim 6, wherein the transmission device comprises a drive gear rotated by the drive motor, and the power divider transmits a rotational power from the drive gear to the pair of the rotators.

8. The device of claim 7, wherein the power divider comprises a first epicyclic gearing for transmitting the rotational power from the drive gear to a first opposed rotator, and a second epicyclic gearing for transmitting the rotational power from the drive gear to a second opposed rotator.

9. The device of claim 8, wherein the first epicyclic gearing comprises a first sun gear for receiving a driving force from the drive gear, a first epicyclic gear meshed with and rotatable around the first sun gear and also meshed with a first final gear rotated integrally with the first opposed rotator and a first link for connecting rotation axes of the first sun gear and first epicyclic gear for rotation of the first link around the first sun gear, the second epicyclic gearing comprises a second sun gear meshed with the first sun gear, a second epicyclic gear meshed with and rotatable around the second sun gear and also meshed with a second final gear rotated integrally with the second opposed rotator and a second link for connecting rotation axes of the second sun gear and second epicyclic gear for rotation of the second link around the second sun gear.

* * * * *